US010520859B2

(12) United States Patent
Abe et al.

(10) Patent No.: US 10,520,859 B2
(45) Date of Patent: Dec. 31, 2019

(54) IMAGE FORMING APPARATUS CONTROLLING SURFACE POTENTIAL OF IMAGE BEARING MEMBER

(71) Applicant: CANON KABUSHIKI KAISHA, Tokyo (JP)

(72) Inventors: Katsuichi Abe, Susono (JP); Kazumi Yamauchi, Suntou-gun (JP); Naoki Fukushima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/636,982

(22) Filed: Jun. 29, 2017

(65) Prior Publication Data

US 2018/0011427 A1 Jan. 11, 2018

(30) Foreign Application Priority Data

Jul. 5, 2016 (JP) ..... 2016-133375

(51) Int. Cl.

| | |
|---|---|
| ***G03G 15/02*** | (2006.01) |
| ***G03G 15/043*** | (2006.01) |
| ***G03G 15/16*** | (2006.01) |
| ***G03G 21/20*** | (2006.01) |

(52) U.S. Cl.

CPC ..... *G03G 15/161* (2013.01); *G03G 15/0266* (2013.01); *G03G 15/167* (2013.01); *G03G 21/203* (2013.01); *G03G 2215/1661* (2013.01); *G03G 2221/0005* (2013.01)

(58) Field of Classification Search

CPC ..... G03G 15/161; G03G 15/0266; G03G 15/167; G03G 21/203; G03G 2215/1661; G03G 2221/0005

USPC ..... 399/66

See application file for complete search history.

(56) References Cited

U.S. PATENT DOCUMENTS

| | | | | |
|---|---|---|---|---|
| 8,543,021 | B2 | 9/2013 | Sakata et al. | |
| 9,310,709 | B2 | 4/2016 | Yaguchi | |
| 2013/0148991 | A1* | 6/2013 | Sakata | G03G 13/22 399/48 |

(Continued)

FOREIGN PATENT DOCUMENTS

| | | | | |
|---|---|---|---|---|
| JP | 3140040 | B2 | 3/2001 | |
| JP | 2010113103 | A * | 5/2010 | G03G 15/0275 |
| JP | 2012-013881 | A | 1/2012 | |

(Continued)

*Primary Examiner* — Susan S Lee

(74) *Attorney, Agent, or Firm* — Venable LLP

(57) ABSTRACT

A control portion executes: a step of calculating a surface potential of an image bearing member charged by a charging member, to which a predetermined voltage is applied, and exposed to light by a predetermined exposure amount on the basis of a discharge start voltage between a measurement member and the image bearing member and calculating a correction value from a difference between a target value and calculated surface potential of the image bearing member; a step of correcting calculated surface potential of the image bearing member on the basis of the correction value; and a step of controlling at least one of the voltage applied to the charging member and an exposure amount of the exposure apparatus on the basis of the corrected surface potential of the image bearing member so that the surface potential of the image bearing member reaches the target value.

19 Claims, 11 Drawing Sheets

(56) References Cited

U.S. PATENT DOCUMENTS

| | | | | |
|---|---|---|---|---|
| 2015/0130886 | A1* | 5/2015 | Yaguchi | G03G 15/043<br>347/224 |
| 2018/0004113 | A1* | 1/2018 | Mori | G03G 15/0266 |

FOREIGN PATENT DOCUMENTS

| | | | | |
|---|---|---|---|---|
| JP | 2015-094858 | A | | 5/2015 |
| JP | 2015-169676 | A | | 9/2015 |
| JP | 2016177025 | A | * | 10/2016 |

* cited by examiner

IMAGE FORMING APPARATUS CONTROLLING SURFACE POTENTIAL OF IMAGE BEARING MEMBER

BACKGROUND OF THE INVENTION

Field of the Invention

The present invention relates to an image forming apparatus that forms an image on a recording medium by using developer.

Description of the Related Art

In an image forming apparatus of an electrophotographic system such as a copying machine or a laser beam printer, first, a photosensitive drum is charged by a charging roller, and the charged photosensitive drum is exposed to light by an exposure apparatus whereby an electrostatic latent image is formed on the photosensitive drum. The electrostatic latent image formed on the photosensitive drum is developed by a developing roller as a toner image. The toner image formed on the photosensitive drum is transferred to a sheet such as paper by a transfer roller. Moreover, the toner image transferred to the sheet is fixed to the sheet by being heated and pressurized by a fixing apparatus. In this way, an image is formed on the sheet.

Here, when a potential $V_L$ is the potential of an exposure portion of the photosensitive drum, a portion of which is a portion exposed to light by the exposure apparatus and a potential Vdc is the surface potential of the developing roller, the electrostatic latent image on the photosensitive drum is developed by the potential difference between the potentials $V_L$ and Vdc. Specifically, an electric field is formed between the surface of the photosensitive drum and the surface of the developing roller by the potential difference between the potentials $V_L$ and Vdc. The toner borne on the surface of the developing roller moves toward the surface of the photosensitive drum by the flow of the electric field. Here, a potential difference $V_{cont}$ between the potentials $V_L$ and Vdc is referred to as a developing contrast.

On the other hand, when a potential $V_D$ is the potential of a non-exposure portion of the photosensitive drum, which is a portion that is not exposed to light by the exposure apparatus, the potential difference $V_{back}$ between the potentials $V_D$ and Vdc is set to such a potential difference that toner does not move from the developing roller toward the non-exposure portion. The potential difference $V_{back}$ between the potentials $V_D$ and Vdc is referred to as a developing back contrast. Here, a phenomenon that toner moves from the developing roller toward the non-exposure portion and adheres to the non-exposure portion is referred to as "fogging". The "fogging" occurs when the developing back contrast does not have a desired value. As described above, in the image forming apparatus of the electrophotographic system, it is necessary to control the potential difference $V_{back}$ and the potential difference $V_{cont}$ appropriately so that an appropriate image is obtained.

Here, it is known that, when a voltage applied to a charging roller is constant, the potential (the potentials of the exposure portion and the non-exposure portion) on the surface of the photosensitive drum changes due to deterioration of the photosensitive drum, a change in sensitivity of the photosensitive drum, or the like. Therefore, conventionally, the potential $V_L$ (the potential of the exposure portion) and the potential $V_D$ (the potential of the non-exposure portion) are predicted on the basis of, for example, a use state (degree of deterioration) (the number of rotations or the like) of the photosensitive drum or the sensitivity of a photosensitive layer of the photosensitive drum. The potentials $V_L$ and $V_D$ are corrected to desired values by changing the voltage to be applied to the charging roller on the basis of this measurement value.

In this way, it was considered that the potential difference $V_{cont}$ and the potential difference $V_{back}$ have desired values and an appropriate image can be obtained. However, in this technique, since the voltage applied to the charging roller is calculated on the basis of a use state or the like of the photosensitive drum rather than the potential of the photosensitive drum, the surface potential of the photosensitive drum is sometimes not controlled to be a desired potential. It was considered that when the voltage applied to the charging roller is calculated on the basis of the surface potential of the photosensitive drum, the values of the potentials $V_L$ and $V_D$ can be corrected with high accuracy.

Therefore, in the technique disclosed in Japanese Patent Application Publication No. 2012-013881, a relational equation among a direct-current voltage (a discharge start voltage) applied to a charging roller when discharge occurs between a photosensitive drum and the charging roller, a surface potential of the photosensitive drum, and the voltage applied to the charging roller is stored in advance. The surface potential of the photosensitive drum is measured by working out the discharge start voltage, and the voltage to be applied to the charging roller is changed on the basis of the measurement value.

However, in the technique disclosed in Japanese Patent Application Publication No. 2012-013881, since the photosensitive drum is charged by the charging roller and the surface potential of the photosensitive drum is measured using the charging roller, the time taken until the potential of the surface of the photosensitive drum is measured increases. Specifically, since the surface potential of the photosensitive drum is measured using the charging roller after the photosensitive drum is charged by the charging roller, the time taken until the surface potential of the photosensitive drum is measured increases.

In the technique disclosed in Japanese Patent Application Publication No. 2015-094858, the surface of a photosensitive drum is charged by a charging roller, and the surface potential of the photosensitive drum is measured using a transfer roller. The relationship between a measurement value of the surface potential of the photosensitive drum and a voltage to be applied to the charging roller is stored in advance in a memory provided in an image forming apparatus, and the voltage to be applied to the charging roller is determined on the basis of the measurement value of the surface potential of the photosensitive drum. In this way, the surface potential of the photosensitive drum can be controlled to be a desired potential in a short period.

However, when the surface potential of the photosensitive drum is measured using the transfer roller, an error may occur in the potential measurement result due to an individual difference or the like between transfer rollers. In this case, since it is not possible to measure the surface potential of the photosensitive drum accurately, an error may occur in the potential applied to the charging roller and the surface potential of the photosensitive drum may not reach a target value. In this way, the potential difference $V_{cont}$ and the potential difference $V_{back}$ may deviate from target values and fogging or the like may occur.

SUMMARY OF THE INVENTION

An object of the present invention is to measure the surface potential of a photosensitive drum with high accuracy to suppress the occurrence of image defects.

Another object of the present invention is to provide an image forming apparatus comprising:

an image bearing member on which a developer image is formed;

a charging member that charges a surface of the image bearing member;

an exposure apparatus that exposes the charged image bearing member to light in order to form an electrostatic latent image on the image bearing member;

a measurement member for measuring a surface potential of the image bearing member; and a control portion that controls a voltage applied to the charging member and an exposure amount of the exposure apparatus, wherein the control portion executes a measurement step of calculating as a measurement value the surface potential of the image bearing member on the basis of a discharge start voltage between the measurement member and the image bearing member, and wherein the control portion executes:

(i) a step of calculating, in the measurement step, the surface potential of the image bearing member when the image bearing member charged by a charging member, to which a predetermined voltage is applied, is exposed to light by a predetermined exposure amount and calculating a correction value from a difference between a target value and the surface potential of the image bearing member calculated in the measurement step;

(ii) a step of correcting the surface potential of the image bearing member calculated in the measurement step on the basis of the correction value; and (iii) a step of controlling at least one of the voltage applied to the charging member and an exposure amount of the exposure apparatus on the basis of the corrected surface potential of the image bearing member so that the surface potential of the image bearing member reaches the target value.

Another object of the present invention is to provide an image forming apparatus comprising:

a cartridge that includes an image bearing member on which a developer image is formed;

a charging member that charges a surface of the image bearing member;

an exposure apparatus that exposes the charged image bearing member to light in order to form an electrostatic latent image on the image bearing member;

a measurement member for measuring a surface potential of the image bearing member; and a control portion that controls a voltage applied to the charging member and an exposure amount of the exposure apparatus, wherein the control portion executes a measurement step of calculating the surface potential of the image bearing member, wherein the control portion acquires a degree of deterioration of the cartridge on the basis of a use state of the cartridge, wherein, when the degree of deterioration of the cartridge is equal to or smaller than a threshold, the control portion executes:

(i) a step of calculating, in the measurement step, a first surface potential of the image bearing member when the image bearing member charged by the charging member, to which the predetermined voltage is applied, is exposed to light by a first exposure amount and calculating a first correction value from a difference between a first target value and a first surface potential of the image bearing member calculated in the measurement step;

(ii) a step of correcting the surface potential of the image bearing member calculated in the measurement step on the basis of the first correction value; and (iii) a step of controlling at least one of the voltage applied to the charging member and the exposure amount of the exposure apparatus on the basis of the corrected surface potential of the image bearing member so that the surface potential of the image bearing member reaches the target value, wherein, when the degree of deterioration of the cartridge is equal to or larger than the threshold, the control portion executes:

(iv) a step of calculating, in the measurement step, a second surface potential of the image bearing member when the image bearing member charged by the charging member, to which the predetermined voltage is applied, is not exposed to light and calculating a second correction value from a difference between a second target value and the second surface potential of the image bearing member calculated in the measurement step;

(v) a step of correcting the surface potential of the image bearing member calculated in the measurement step on the basis of the second correction value; and (vi) a step of controlling at least one of the voltage applied to the charging member and the exposure amount of the exposure apparatus on the basis of the corrected surface potential of the image bearing member so that the surface potential of the image bearing member reaches the target value.

Another object of the present invention is to provide an image forming apparatus comprising:

an image bearing member on which a developer image is formed;

a charging member that charges a surface of the image bearing member;

an exposure apparatus that exposes the charged image bearing member to light in order form an electrostatic latent image on the image bearing member;

a measurement member for measuring a surface potential of the image bearing member; and a control portion that controls a voltage applied to the charging member and an exposure amount of the exposure apparatus, wherein the control portion executes a measurement step of calculating the surface potential of the image bearing member, wherein the control portion acquires a degree of deterioration of the cartridge on the basis of a use state of the cartridge, wherein, when an integrated number of rotations of the image bearing member is equal to or smaller than a threshold, the control portion executes:

(i) a step of calculating, in the measurement step, a first surface potential of the image bearing member when the image bearing member charged by the charging member, to which the predetermined voltage is applied, is exposed to light by a first exposure amount and calculating a first correction value from a difference between a first target value and a first surface potential of the image bearing member calculated in the measurement step;

(ii) a step of correcting the surface potential of the image bearing member calculated in the measurement step on the basis of the first correction value; and (iii) a step of controlling at least one of the voltage applied to the charging member and the exposure amount of the exposure apparatus on the basis of the corrected surface potential of the image bearing member so that the surface potential of the image bearing member reaches the target value, wherein, when the integrated number of rotations of the image bearing member is equal to or larger than the threshold, the control portion executes:

(iv) a step of calculating, in the measurement step, a second surface potential of the image bearing member when the image bearing member charged by the charging member, to which the predetermined voltage is applied, is exposed to light by a second exposure amount smaller than the first exposure amount and calculating a second correction value from a difference between a second target value and the second surface potential of the image bearing member calculated in the measurement step;

(v) a step of correcting the surface potential of the image bearing member calculated in the measurement step on the basis of the second correction value; and (vi) a step of controlling at least one of the voltage applied to the charging member and the exposure amount of the exposure apparatus on the basis of the corrected surface potential of the image bearing member so that the surface potential of the image bearing member reaches the target value.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

(1) Configuration of Image Forming Apparatus and Image Forming Process

Figure 2:
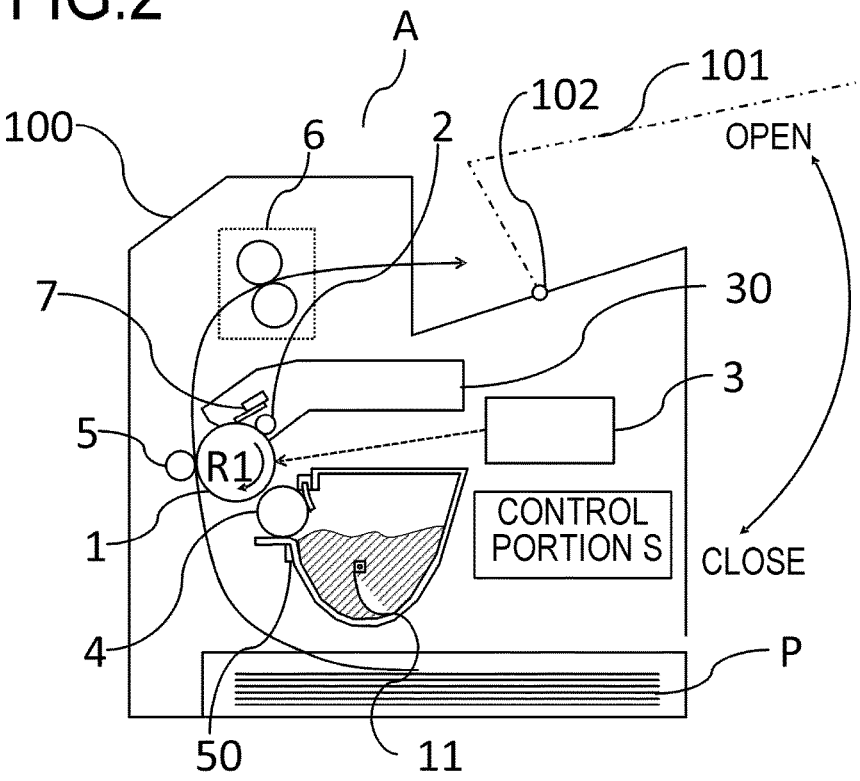
FIG. 2 is a schematic diagram of an image forming apparatus according to Embodiment 1.

FIG. 2 is a schematic diagram of an image forming apparatus A according to Embodiment 1. In the present embodiment, the image forming apparatus A is a laser beam printer of an electrophotographic system. An external host apparatus such as a PC or an image reading apparatus is connected to the image forming apparatus A whereby image information is transmitted to the image forming apparatus A and the image forming apparatus A forms an image.

In the present embodiment, a cartridge as a process cartridge is detachably attached to an apparatus body 100 of the image forming apparatus A. Moreover, the cartridge has a configuration in which a photosensitive drum 1 as an image bearing member, a charging roller 2 as a charging member, a developing apparatus 11, and a cleaning apparatus 30 are integrated. Moreover, an opening/closing cover 101 of the apparatus body 100 is open and closed about a hinge shaft 102 so that the inside of the apparatus body 100 can be exposed to light. By opening/closing the opening/closing cover 101, the cartridge can be detachably attached to a predetermined position inside the apparatus body 100.

The cartridge is attached to the apparatus body 100 whereby a state in which the cartridge and the apparatus body 100 are mechanically and electrically coupled is created. In this state, the image forming apparatus A can perform printing. The photosensitive drum 1 which is a drum-shaped electrophotographic photosensitive member is rotated at a predetermined rotation speed in the direction indicated by arrow R1 on the basis of a print start signal. The charging roller 2 to which a charging bias is applied is in contact with the photosensitive drum 1, an outer circumferential surface of the rotating photosensitive drum 1 is uniformly charged to a predetermined polarity and potential by the charging roller 2 (charging step).

The charged surface of the photosensitive drum 1 is exposed to light by a scanner 3 as an exposure apparatus according to image information. Specifically, the scanner 3 outputs a laser beam modulated according to an electrical signal for the image information input from a host apparatus and scans and exposes the surface of the photosensitive drum 1. In this way, an electrostatic latent image composed of a bright-part potential portion and a dark-part potential portion is formed on the photosensitive drum 1. Specifically, the bright-part potential portion is a portion of the charged surface of the photosensitive drum 1, which is exposed to the laser beam by the scanner 3, and the dark-part potential portion is a portion which is not exposed to the laser beam by the scanner 3 (exposure step).

This electrostatic latent image is developed by a developing sleeve 4 of the developing apparatus 11. The developing sleeve 4 is disposed to face the photosensitive drum 1 and bears toner thereon. The electrostatic latent image is developed by the developing sleeve 4 whereby a toner image as a developer image is formed on the outer circumferential surface of the photosensitive drum 1 (developing step). Moreover, a transfer roller 5 as a measurement member and a transfer member is a roller-shaped transfer means. The transfer roller 5 is disposed to face the photosensitive drum 1. When a recording medium P conveyed toward the transfer roller 5 at a predetermined timing passes through the transfer roller 5, a transfer bias is applied to the transfer roller 5 whereby the toner image formed on the outer circumferential surface of the photosensitive drum 1 is transferred to the surface of the recording medium P (transfer step).

The recording medium P to which the toner image is transferred is conveyed to a fixing apparatus 6, and the toner image on the recording medium P is heated and pressurized by the fixing apparatus 6. In this way, the toner transferred to the recording medium P is fixed to the recording medium P (fixing step). Moreover, a C-blade 7 (cleaning blade) removes transfer residual toner or the like remaining on the photosensitive drum 1 (image bearing member) after the toner image is transferred to the recording medium P (cleaning step).

By repeating the above-described image forming process (the charging step, the exposure step, the developing step, the transfer step, the fixing step, and the cleaning step), an image is repeatedly formed on the recording medium P. Here, in the present embodiment, it is assumed that a memory 50 is provided in the cartridge. Information such as a travel distance (a total moving distance of the outer circumferential surface of the photosensitive drum 1) and time information (a total rotation time of the photosensitive drum 1) of the photosensitive drum 1, and a charging period (a total period in which the charging roller 2 charges the photosensitive drum 1) is recorded in the memory 50. Moreover, when the cartridge is attached to the apparatus body 100, the memory 50 is electrically connected to a control portion S provided in the apparatus body 100. In this way, the apparatus body 100 determines the use state (the travel distance and the like of the photosensitive drum 1) of the photosensitive drum 1 on the basis of the information stored in the memory 50. For example, it is assumed that the relationship between the travel distance of the photosensitive drum 1 and the use state (the degree of deterioration) of the photosensitive drum 1 is stored in the memory 50. The use state (the degree of deterioration) of the photosensitive drum 1 may be acquired on the basis of the relationship stored in the memory 50 and the travel distance of the photosensitive drum 1.

In the present embodiment, the travel distance and the like of the photosensitive drum 1 are stored in the memory 50 in order to determine the use state of the photosensitive drum 1, but the present invention is not necessarily limited thereto. The information stored in the memory 50 is not particularly limited but may be information with which the use state of the photosensitive drum 1 can be determined. For example, the information stored in the memory 50 may be the travel distance (the total moving distance of the outer circumferential surface of the photosensitive drum 1) and the time information (the total period in which the photosensitive drum 1 rotates) of the photosensitive drum 1, and the charging period (the total period in which the charging roller 2 charges the photosensitive drum 1). Moreover, the information stored in the memory 50 may be charging voltage information (the value of a voltage applied to the charging roller 2), a developing period (a total period in which an electrostatic latent image is developed by the developing sleeve 4), and a developer consumption amount (a toner consumption amount). Moreover, the information stored in the memory 50 may be a developing member contacting period (a total period in which the developing sleeve 4 is in contact with the photosensitive drum 1). For example, the relationship between the degree of deterioration of the cartridge (or the degree of deterioration of the photosensitive drum 1) and at least one of an integrated number of rotations of the photosensitive drum 1, an integrated rotation period of the photosensitive drum 1, a period in which the charging roller 2 charges the photosensitive drum 1, and a toner consumption amount are stored in the memory 50. The relationship corresponds to a first relationship. The control portion S acquires the degree of deterioration of the cartridge on the basis of the relationship stored in the memory 50 and the integrated number of rotations or the like of the photosensitive drum 1. That is, it is determined that the larger the integrated number of rotations of the photosensitive drum 1, the higher the degree of deterioration of the cartridge.

In the present embodiment, although the information for determining the use state of the photosensitive drum 1 is stored in the memory 50 attached to the cartridge, the present invention is not necessarily limited thereto. However, it is sufficient that the use state of the photosensitive drum 1 is properly recognized by the apparatus body 100. For example, the memory 50 may be provided in the apparatus body 100. Moreover, the travel distance value of the photosensitive drum 1 may be reset when the photosensitive drum 1 is replaced, for example.

(2) Detailed Description of Members Used for Image Formation

Next, members used for image formation will be described in detail.

(a) Photosensitive drum 1, Charging Roller 2, Scanner 3, and Transfer Roller 5

In the present embodiment, the photosensitive drum 1 is a rigid member and is formed by sequentially coating the outer circumferential surface of an aluminum cylinder having a diameter of 30 mm with a resistance layer, an undercoating layer, a charge generation layer, and a charge transport layer according to a dipping coat method. Here, in the present embodiment, the thickness of the charge transport layer is 25 μm.

The charging roller 2 is formed by coating a core having a diameter of 6 mm with a base layer of hydrin rubber and a surface layer of urethane so that the charging roller 2 has an outer diameter of 12 mm. Moreover, in the present embodiment, the resistance of the charging roller 2 is $1\times10^6\Omega$ and the hardness of the charging roller 2 is 40° when was measured using the Asker C rubber durometer (product of Kobunshi Keiki Co., Ltd.). Moreover, the scanner 3 is configured to be able to change the amount of laser beam irradiated to the surface of the photosensitive drum 1 and the wavelength of the irradiated laser is 800 nm. Moreover, the scanner 3 is a semiconductor laser. Here, in the present embodiment, the amount of laser beam irradiated to the surface of the photosensitive drum 1 is 3 $mJ/m^2$ when an image is formed.

The transfer roller 5 is formed by forming a base layer of ion conductive sponge on the core having a diameter of 6 mm so that the transfer roller 5 has an outer diameter of 15 mm. Moreover, the resistance of the transfer roller 5 is $4\times10^7\Omega$ under the temperature environment of 22° C. and the hardness of the transfer roller 5 is 30° when measured using the Asker C rubber durometer (product of Kobunshi Keiki Co., Ltd.).

Figure 3:
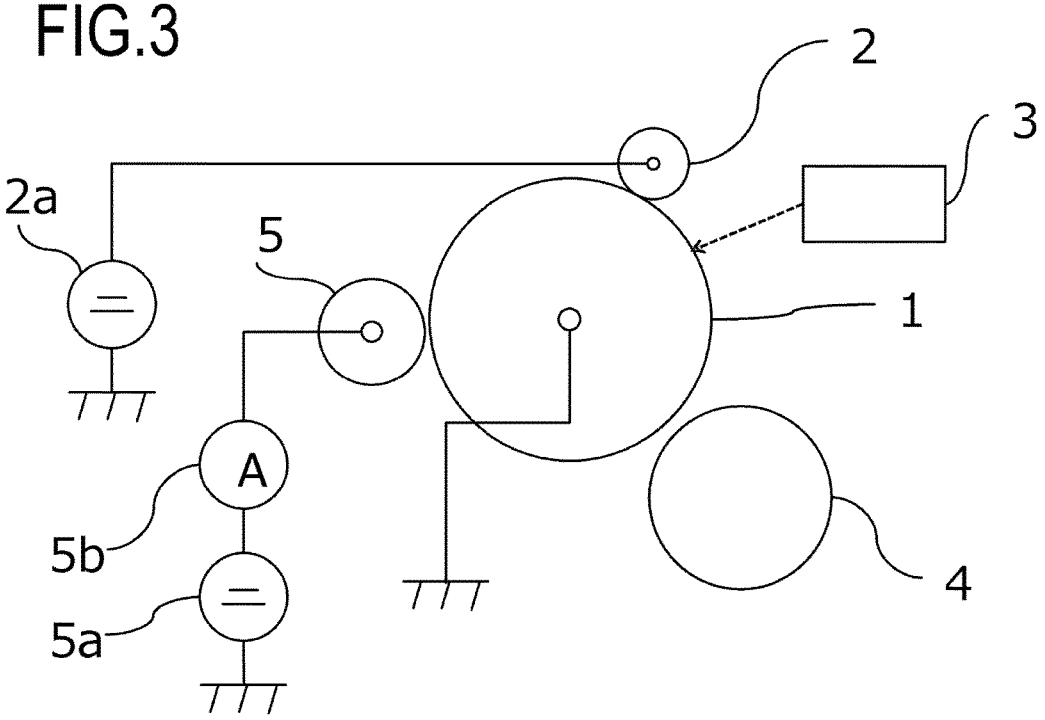
FIG. 3 is a schematic diagram illustrating means for detecting a surface potential of a photosensitive drum according to Embodiment 1.

Next, the arrangement of the photosensitive drum 1, the charging roller 2, the scanner 3, and the transfer roller 5 will be described with reference to FIG. 3. FIG. 3 is a schematic diagram illustrating means for detecting the surface potential of the photosensitive drum 1 according to the present embodiment. The charging roller 2 is disposed to make contact with the photosensitive drum 1, and the scanner 3 is disposed so that the laser beam is irradiated to the outer circumferential surface of the photosensitive drum 1. Moreover, the developing sleeve 4 and the transfer roller 5 are disposed to face the photosensitive drum 1. The charging roller 2 is connected to a charging voltage application circuit for applying a charging voltage and a transfer voltage application circuit for applying a transfer voltage is connected to the transfer roller 5.

Here, a charging voltage application circuit 2*a* is a circuit for applying a charging voltage which is a direct-current voltage to the charging roller 2. The charging voltage application circuit 2*a* is connected to a constant voltage power supply and the output value thereof is 1000 V. A direct-current voltage is output from the constant voltage power supply whereby a charging voltage is applied to the photosensitive drum 1 via the charging roller 2. In this way, a dark-part potential $V_D$ on the outer circumferential surface of the photosensitive drum 1 is constantly 500 V. The photosensitive drum 1 of which the outer circumferential surface is uniformly charged by the charging roller 2 is scanned and exposed to light by the scanner 3, and a bright-part potential $V_L$ of 100 V is formed on the photosensitive drum 1.

In the present embodiment, the bright-part potential portion $V_L$ on the photosensitive drum 1 is conveyed toward the transfer roller 5. Here, in the present embodiment, the transfer voltage application circuit 5*a* is a circuit that applies a transfer voltage which is a direct-current voltage to the transfer roller 5. Moreover, the transfer voltage application circuit 5*a* is connected to the constant voltage power supply. A direct-current voltage is output from the constant voltage power supply whereby a transfer voltage is applied to the photosensitive drum 1 via the transfer roller 5. Moreover, in the present embodiment, a transfer current detection circuit 5*b* is a circuit that detects a current value flowing in the photosensitive drum 1 when a voltage is applied from the transfer voltage application circuit 5*a* to the photosensitive drum 1.

(b) Means for Detecting Surface Potential of Photosensitive Drum 1

Next, means for detecting the surface potential of the photosensitive drum 1 will be described in detail. In the present embodiment, a process of measuring the surface potential of the photosensitive drum 1 using the transfer roller 5 is employed. In the present embodiment, the surface potential of the photosensitive drum 1 is detected by detecting and comparing the transfer voltage value applied to the transfer roller 5 and the transfer current value flowing in the photosensitive drum 1 via the transfer roller 5. However, a method of detecting the surface potential of the photosensitive drum 1 is not necessarily limited thereto.

Figure 4:
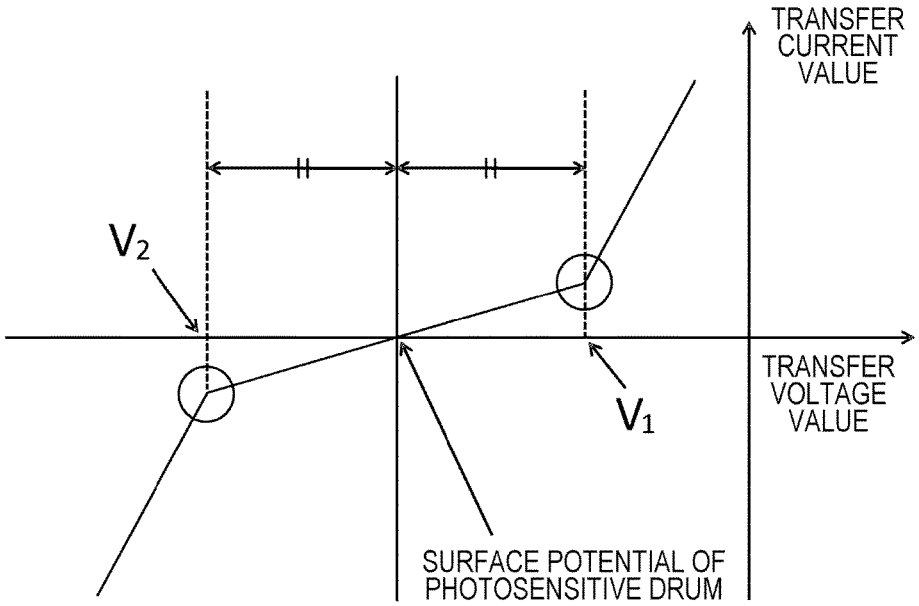
FIG. 4 is a diagram illustrating the relationship between a transfer voltage value and a transfer current value.

A method of calculating the bright-part potential $V_L$ on the photosensitive drum 1 will be described with reference to FIG. 4. FIG. 4 is a diagram illustrating the relationship between a transfer voltage value and a transfer current value. As described above, the transfer voltage value is the value of a transfer voltage applied to the transfer roller 5, and the transfer current value is the value of a transfer current flowing in the photosensitive drum 1 via the transfer roller 5. In FIG. 4, the horizontal axis indicates a transfer voltage value and the vertical axis indicates a transfer current value.

Here, according to the Paschen's law, when a transfer voltage value reaches a predetermined value, a discharge starts to occur between the bright-part potential $V_L$ of the photosensitive drum 1 and the transfer roller 5. In this case, the transfer voltage value is referred to as a discharge start voltage. A positive discharge start voltage and a negative discharge start voltage for the discharge occurring between the bright-part potential $V_L$ and the transfer roller 5 are referred to as a voltage $V_1$ and a voltage $V_2$, respectively. Here, the discharge start voltage value depends on the bright-part potential $V_L$, the atmospheric pressure between the photosensitive drum 1 and the transfer roller 5, and the distance between the photosensitive drum 1 and the transfer roller 5. When the bright-part potential $V_L$ is detected, if the atmospheric pressure between the photosensitive drum 1 and the transfer roller 5 and the distance between the photosensitive drum 1 and the transfer roller 5 do not change, the absolute value of the potential difference between the voltage $V_1$ and the bright-part potential $V_L$ becomes equal to the absolute value of the potential difference between the voltage $V_2$ and the bright-part potential $V_L$. Due to this, the relationship between the transfer voltage value and the transfer current value is symmetrical about the bright-part potential $V_L$ as illustrated in FIG. 4. That is, the following equation (1) (corresponding to a third relationship) is satisfied between the bright-part potential $V_L$ of the photosensitive drum 1 and the voltages $V_1$ and $V_2$ which are the discharge start voltages.

$$V_L=(V_1+V_2)/2 \qquad \text{Equation (1)}$$

In the present embodiment, the bright-part potential $V_L$ of the photosensitive drum 1 is calculated using Equation (1) and the discharge start voltages $V_1$ and $V_2$. In the present embodiment, although the bright-part potential $V_L$ of the photosensitive drum 1 is detected using the transfer roller 5, the present invention is not necessarily limited thereto. A member for measuring the bright-part potential $V_L$ of the photosensitive drum 1 may be a conductive member which makes contact with or faces the photosensitive drum 1, to which a voltage can be applied, and which can detect a current and a voltage between the photosensitive drum 1 and the member. For example, the member for measuring the bright-part potential $V_L$ of the photosensitive drum 1 may be the charging roller 2 or the like.

In the present embodiment, although the bright-part potential $V_L$ of the photosensitive drum 1 is calculated by detecting the transfer current value flowing in the photosensitive drum 1 when the transfer voltage is applied to the transfer roller 5, the present invention is not necessarily limited thereto. For example, the bright-part potential $V_L$ may be calculated by detecting the voltage between the photosensitive drum 1 and the transfer roller 5 when a constant current is applied to the transfer roller 5. Moreover, by the above-described method, it is possible to calculate the dark-part potential $V_D$ on the photosensitive drum 1 as well as the bright-part potential $V_L$ on the photosensitive drum 1.

(c) Method of Correcting Measurement Value of the Surface Potential of Photosensitive Drum 1

Conventionally, when the transfer roller 5 is manufactured, bubbles may be formed in the base layer of the transfer roller 5 and toner, dust, or the like may adhere to the transfer roller 5. Due to this, convex and concave portions may be formed on the surface of the transfer roller 5 and an error may occur in the measurement result of the surface potential of the photosensitive drum 1. Therefore, it is necessary to correct the measurement result of the surface potential of the photosensitive drum 1.

Therefore, in the present embodiment, first, the surface potential of the photosensitive drum 1 is adjusted to a predetermined reference surface potential 1. Here, the reference surface potential 1 is the surface potential of the photosensitive drum 1 and is such a potential that an error other than the error in the measurement result caused by the transfer roller 5 is minimized. Moreover, the reference surface potential 1 is the surface potential of the photosensitive drum 1 when exposed with such an exposure amount that an error other than an error in the measurement result caused by the transfer roller 5 is smaller than an error other than the error in the measurement result caused by the transfer roller 5 during printing. However, in the present embodiment, the reference surface potential 1 may not be such a surface potential of the photosensitive drum 1 that the error other than the error in the measurement result caused by the transfer roller 5 is minimized. For example, the reference surface potential 1 may be such a surface potential of the photosensitive drum 1 that an error other than the error in the measurement result caused by the transfer roller 5 decreases. The error other than the error in the measurement result caused by the transfer roller 5 is a tolerance of a high-voltage circuit in the apparatus body 100 of the image forming apparatus A, an error occurring due to an individual difference between cartridges, and the like.

In the present embodiment, the surface of the charged photosensitive drum 1 is exposed to light by the scanner 3 with an exposure amount (corresponding to a first exposure amount) larger than the exposure amount when forming an image in order to control the surface potential of the photosensitive drum 1 to be the reference surface potential 1. Moreover, in the present embodiment, the surface potential of the photosensitive drum 1 is measured using the transfer roller 5 in a state in which the surface potential of the photosensitive drum 1 is controlled to be the reference surface potential 1. The measurement value of the surface potential of the photosensitive drum 1 is corrected on the basis of the measurement result of the surface potential of the photosensitive drum 1 and the target value of the surface potential of the photosensitive drum 1.

(d) Reference Surface Potential 1 of Photosensitive Drum 1

Figure 5:
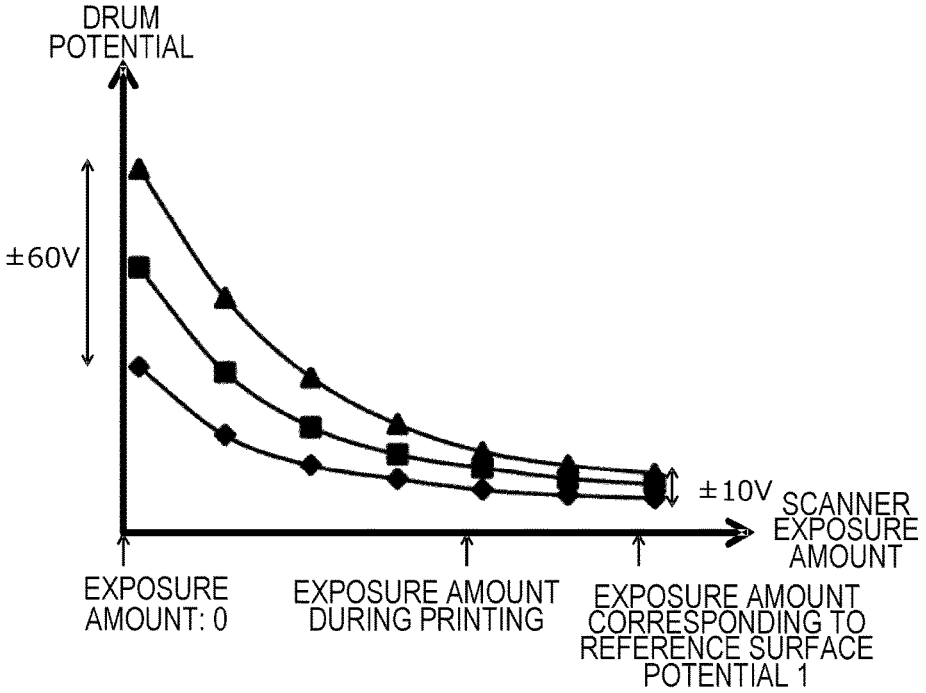
FIG. 5 is a diagram illustrating the relationship between an exposure amount of a scanner and a surface potential of a photosensitive drum.

FIG. 5 is a diagram illustrating the relationship between the exposure amount of the scanner 3 and the surface potential of the photosensitive drum 1 when the photosensitive drum 1 is in a non-used state. When a plurality of photosensitive drums is charged by controlling the voltage applied to the charging roller 2 in a similar manner, as illustrated in FIG. 5, the surface potentials of the photosensitive drums 1 after being exposed to light by the scanner 3 vary. Such a variation occurs due to a tolerance of the high-voltage circuit in the apparatus body 100 of the image forming apparatus A, an individual difference between the photosensitive drums 1, and the like. As illustrated in FIG. 5, the dark-part potential $V_D$ (the potential of a non-exposed portion) of the photosensitive drum 1 has a variation of ±60 V.

As illustrated in FIG. 5, it is understood that the larger the exposure amount of the scanner 3, the smaller the variation in the surface potential of the photosensitive drum 1. In the present embodiment, the reference surface potential 1 is formed by exposing the surface of the photosensitive drum with an exposure amount (in the present embodiment, 3.5 $mJ/m^2$) larger than that when an image is formed on the recording medium P. In this case, as illustrated in FIG. 5, the variation in the reference surface potential 1 resulting from a tolerance in the high-voltage circuit of the image forming apparatus A, an individual difference between the photosensitive drums 1, and the like is ±10 V. A method of correcting the measurement value of the surface potential of the photosensitive drum 1 will be described in detail later.

Here, the exposure amount of the scanner 3 during printing is determined so that the bright-part potential $V_L$ is stabilized and is determined by taking a gradation of the pattern of the electrostatic latent image formed on the photosensitive drum 1 into consideration. On the other hand, the reference surface potential 1 may be determined by taking only the stability of the surface potential of the photosensitive drum 1 into consideration. Due to this, when a variation in the surface potential of the photosensitive drum 1 under the exposure amount of the scanner 3 during printing, for example, is small, the reference surface potential 1 may be formed on the photosensitive drum 1 using the exposure amount of the scanner 3 during printing. As in the present embodiment, it is more preferable to form the reference surface potential 1 on the photosensitive drum 1 using an exposure amount larger than the exposure amount of the scanner 3 during printing.

(3) Flow of Image Forming Operation of Present Embodiment

Figure 1:
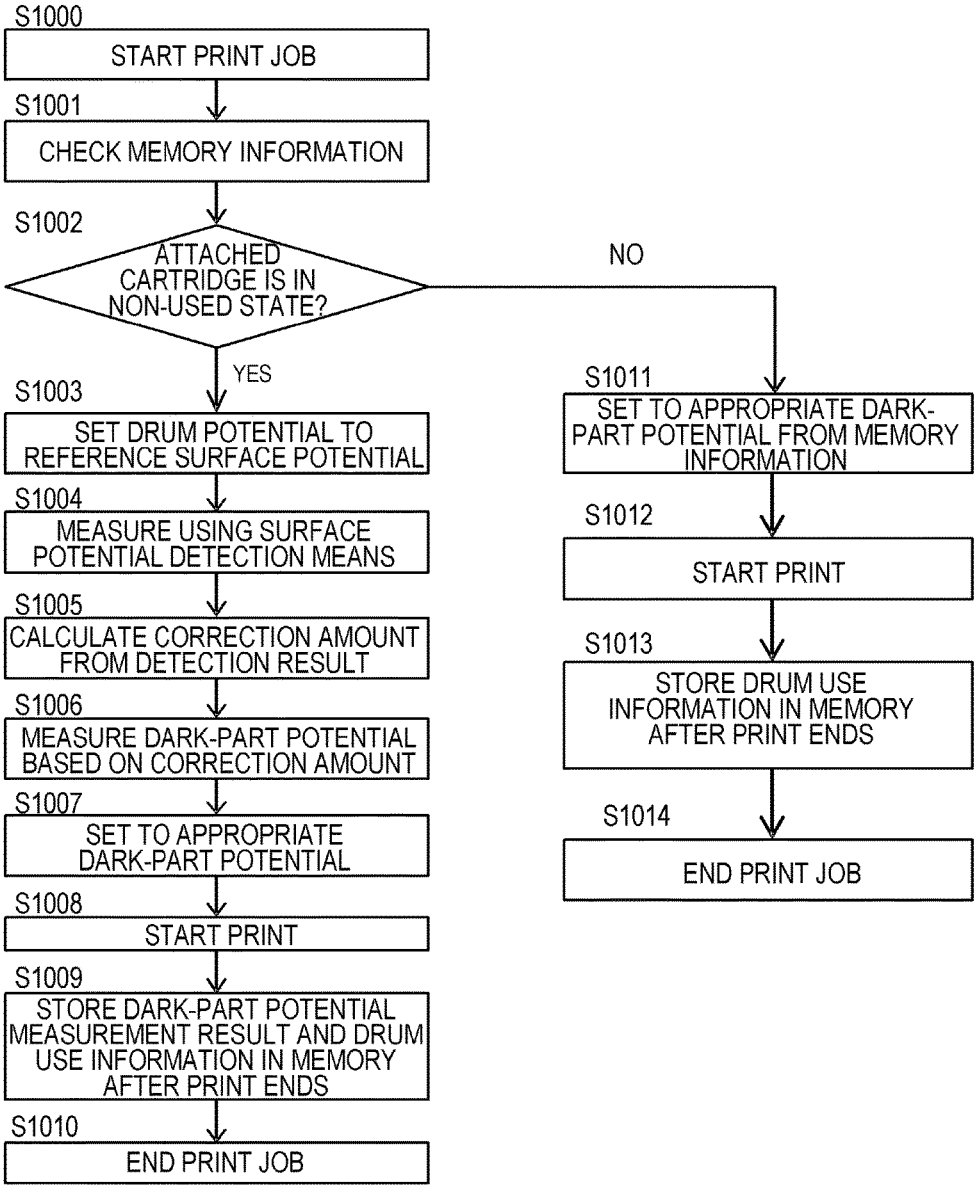
FIG. 1 is a flowchart illustrating the flow of an image forming operation according to the present embodiment.

FIG. 1 is a flowchart illustrating the flow of an image forming operation according to the present embodiment. In the present embodiment, the dark-part potential $V_D$ of the photosensitive drum 1 is controlled to be a desired value by correcting the measurement value of the surface potential of the photosensitive drum 1 on the basis of the reference surface potential 1 formed on the photosensitive drum 1. Hereinafter, the flow of the image forming operation according to the present embodiment will be described with reference to FIG. 1.

In S1000, a print job execution instruction is input from a user, and the control portion S controls the operation of the image forming apparatus A on the basis of the instruction whereby a print job starts.

In S1001, the control portion S executes a program stored in the memory 50 as a storage portion to acquire information on the memory 50 provided in the cartridge. For example, the control portion S executes a program stored in the memory 50 to acquire the total number of rotations of the photosensitive drum 1 from the memory 50.

In S1002, the control portion S executes a program stored in the memory 50 to acquire information indicating whether the cartridge is a new product or the cartridge is in a state close to a new product. For example, a threshold for determining whether the cartridge is in a state close to a new product is stored in advance in the memory 50, and it is determined that the cartridge is in a state close to a new product when the acquired information indicates a value equal to or larger than the threshold. For example, it is determined that the cartridge is in a state close to the new product when the total number of rotations of the photosensitive drum 1 does not exceed 500.

In S1003, the control portion S controls the operation of the charging voltage application circuit 2*a* whereby the charging voltage application circuit 2*a* applies a predetermined voltage to the charging roller 2, and the charging roller 2 charges the photosensitive drum 1. Moreover, the control portion S controls the operation of the scanner 3 whereby the scanner 3 exposes the photosensitive drum 1 with a predetermined exposure amount and the surface potential of the photosensitive drum 1 is controlled to be the reference surface potential 1. Here, in the present embodiment, the reference surface potential 1 is such a potential that an error caused by temperature and humidity environments, a shift in the bias applied to the charging roller 2, a shift due to a tolerance of the charging roller 2, and the like is ±10 V.

In the present embodiment, as illustrated in FIG. 5, when the exposure amount irradiated to the photosensitive drum 1 is 0, an error resulting from the temperature and humidity environments, a shift in the bias applied to the charging roller 2, a shift due to the tolerance of the charging roller 2, and the like is ±60 V. Here, it is assumed that the relationship between the exposure amount irradiated to the photosensitive drum 1 and an error resulting from the temperature and humidity environments, a shift in the bias applied to the charging roller 2, a shift due to the tolerance of the charging roller 2, and the like is obtained in advance by an experiment and is stored in advance in the memory 50. The scanner 3 exposes the photosensitive drum 1 with such an exposure amount that the error is ±10 V.

In S1004, the control portion S operates the operation of the transfer roller 5 whereby the surface potential of the photosensitive drum 1 is used using the transfer roller 5. Specifically, as described above, the potential of the surface (the surface of the image bearing member) of the photosensitive drum 1 is measured on the basis of the graph illustrated in FIG. 4, Equation (1), the discharge start voltage $V_1$, and the discharge start voltage $V_2$. Here, in the above description, although the bright-part potential $V_L$ of the photosensitive drum 1 is calculated, the surface potential of the photosensitive drum 1 is also measured by the same method.

In S1005, the control portion S executes a program stored in the memory 50 whereby an error in the measurement value of the surface potential of the photosensitive drum 1—an error measured by using the transfer roller 5—is derived. Specifically, in a state in which the surface potential of the photosensitive drum 1 is controlled to be the reference surface potential 1, a difference between the measurement value (the measurement value obtained using the transfer roller 5) and the target value of the surface potential of the photosensitive drum 1 is referred to an error in the measurement value resulting from the transfer roller 5.

In the present embodiment, the target value of the surface potential of the photosensitive drum 1 in a state in which the surface potential of the photosensitive drum 1 is controlled to be the reference surface potential 1 is stored in advance in the memory 50. Moreover, the control portion S executes the program stored in the memory 50 whereby a difference between the measurement value of the surface potential of the photosensitive drum 1 and the target value of the surface potential of the photosensitive drum 1 is derived. The difference between the measurement value of the surface potential of the photosensitive drum 1 and the target value of the surface potential of the photosensitive drum 1 is regarded as an error in the measurement value resulting from the transfer roller 5. This error is stored in the memory 50 as a correction amount, and the measurement value of the surface potential of the photosensitive drum 1 is corrected on the basis of the stored correction amount.

In the present embodiment, for example, when the exposure amount irradiated to the photosensitive drum 1 is set to 0, as illustrated in FIG. 5, a variation in the surface potential of the photosensitive drum 1 resulting from a shift or the like in the bias applied to the charging roller 2 is ±60 V. In this case, when a difference between the measurement value of the surface potential of the photosensitive drum 1 and the target value of the surface potential of the photosensitive drum 1 is regarded as an error in the measurement value resulting from the transfer roller 5, the variation in the error is also ±60 V.

However, in the present embodiment, the error is measured in a state in which a variation in the surface potential of the photosensitive drum 1 resulting from a shift or the like in the bias applied to the charging roller 2 is ±10 V. Due to this, a variation in the error in the measurement value resulting from the transfer roller 5 is also ±10 V. That is, in the present embodiment, a difference between the measurement value of the surface potential of the photosensitive drum 1 and the target value of the surface potential of the photosensitive drum 1 in a state in which an error other than the error resulting from the transfer roller 5 is very small (±10 V) is regarded as an error resulting from the transfer roller 5. In this way, since the error resulting from the transfer roller 5 can be calculated with high accuracy, the surface potential of the photosensitive drum 1 can be measured with high accuracy.

In S1006, the control portion S executes a program stored in the memory 50 whereby the measurement value of the surface potential of the photosensitive drum 1 is corrected on the basis of the correction value derived in S1005. Specifically, by adding or subtracting the correction value calculated in S1005 to or from the measurement value of the surface potential of the photosensitive drum 1 measured using the transfer roller 5, the measurement value of the surface potential of the photosensitive drum 1 is corrected. In this way, it is possible to measure the surface potential of the photosensitive drum 1 with high accuracy.

In S1007, the charging amount on the photosensitive drum 1 of the charging roller 2 is derived on the basis of the corrected measurement value of the surface potential of the photosensitive drum 1 and the photosensitive drum 1 is charged with the charging amount. Specifically, a relational equation (corresponding to a second relationship) (charging amount=initial charging amount+coefficient A×number of rotations of photosensitive drum 1) (the initial charging amount is obtained, for example, from a table that shows the relationship between an initial surface potential of the photosensitive drum 1 and the initial charging amount) is stored in the memory 50. The charging amount on the photosensitive drum 1 is determined using this relational equation. In the present embodiment, since the measurement accuracy of the initial surface potential of the photosensitive drum 1 is high, the initial charging amount can be controlled to be a desired value and the dark-part potential $V_D$ of the photosensitive drum 1 can be controlled to approach a desired value. In this way, it is possible to suppress toner from being transferred to a portion corresponding to the dark-part potential $V_D$ (that is, fogging can be suppressed). The portion of the surface of the photosensitive drum 1 other than the dark-part potential portion $V_D$ is exposed to light whereby a bright-part potential portion $V_L$ is formed on the surface of the photosensitive drum 1. Here, in the present embodiment, the dark-part potential $V_D$ of the photosensitive drum 1 is controlled to be a desired value by changing the charging amount of the charging roller 2. However, the present invention is not necessarily limited thereto, but the dark-part potential $V_D$ of the photosensitive drum 1 may be controlled to be a desired value by changing the exposure amount of the scanner 3, for example.

In the present embodiment, as illustrated in the relational equation, the charging amount on the photosensitive drum 1 is corrected according to the use state (the number of rotations of the photosensitive drum 1) of the cartridge.

Here, for example, when the cartridge is used for a long period of time, since the film thickness on the photosensitive drum 1 becomes thin, the surface potential of the photosensitive drum 1 after exposure also changes. However, as in the present embodiment, it is possible to control the surface potential of the photosensitive drum 1 to be a desired value by changing the charging amount on the photosensitive drum 1 according to the use state of the cartridge.

In S1008, the control portion S controls the operation of devices in the image forming apparatus A whereby the image forming apparatus A executes a print operation. Specifically, the control portion S controls the operation of the developing apparatus, the transfer roller 5, the fixing apparatus 6, and the like whereby an image is formed on the recording medium P.

In S1009, after the print operation ends, the initial charging amount obtained in S1007 and information (for example, the number of rotations of the photosensitive drum 1) and the like acquired in S1001 are stored in the memory 50.

In S1010, the control portion S controls the operation of devices in the image forming apparatus A whereby the print job ends.

In S1011, the charging amount on the photosensitive drum 1 is derived on the basis of the initial charging amount (the value obtained in S1007) stored in the memory 50, the number of rotations of the photosensitive drum 1, and the equation used in S1007. The photosensitive drum 1 is charged with the charging amount. In this way, as described above, the occurrence of fogging is suppressed. Moreover, at the same time, the photosensitive drum 1 is exposed to light whereby the bright-part potential portion $V_L$ is formed on the surface of the photosensitive drum 1.

In S1012, the control portion S controls the operation of devices in the image forming apparatus A whereby the image forming apparatus executes a print operation as described above.

In S1013, after the print operation ends, the information (for example, the number of rotations of the photosensitive drum 1) acquired in S1001 is stored in the memory 50.

In S1014, the control portion S controls the operation of devices in the image forming apparatus A whereby the print job ends.

In the present embodiment, although the use state (the total number of rotations or the like of the photosensitive drum 1) of the photosensitive drum 1 is stored in the memory 50 in S1009 and S1013, the present invention is not necessarily limited thereto. However, it is sufficient that the difference between the dark-part potential $V_D$ of the photosensitive drum 1 and the potential of the developing sleeve 4 can be controlled to be a desired value. For example, the correction amount obtained in S1005 may be stored in the memory 50, and the dark-part potential portion $V_D$ of the photosensitive drum 1 may be formed using this correction amount in S1011.

In the present embodiment, although the dark-part potential $V_D$ is controlled to be a desired value so that an appropriate image is formed until the cartridge reaches its lifespan, the present invention is not necessarily limited thereto. However, it is sufficient that the difference (hereinafter referred to as a potential difference $V_{back}$) between the dark-part potential $V_D$ and the potential of the developing sleeve 4 can be controlled to be a desired value. For example, the potential difference $V_{back}$ may be controlled to be a desired value by correcting the potential of the developing sleeve 4.

(4) Comparative Example 1

Figure 8:
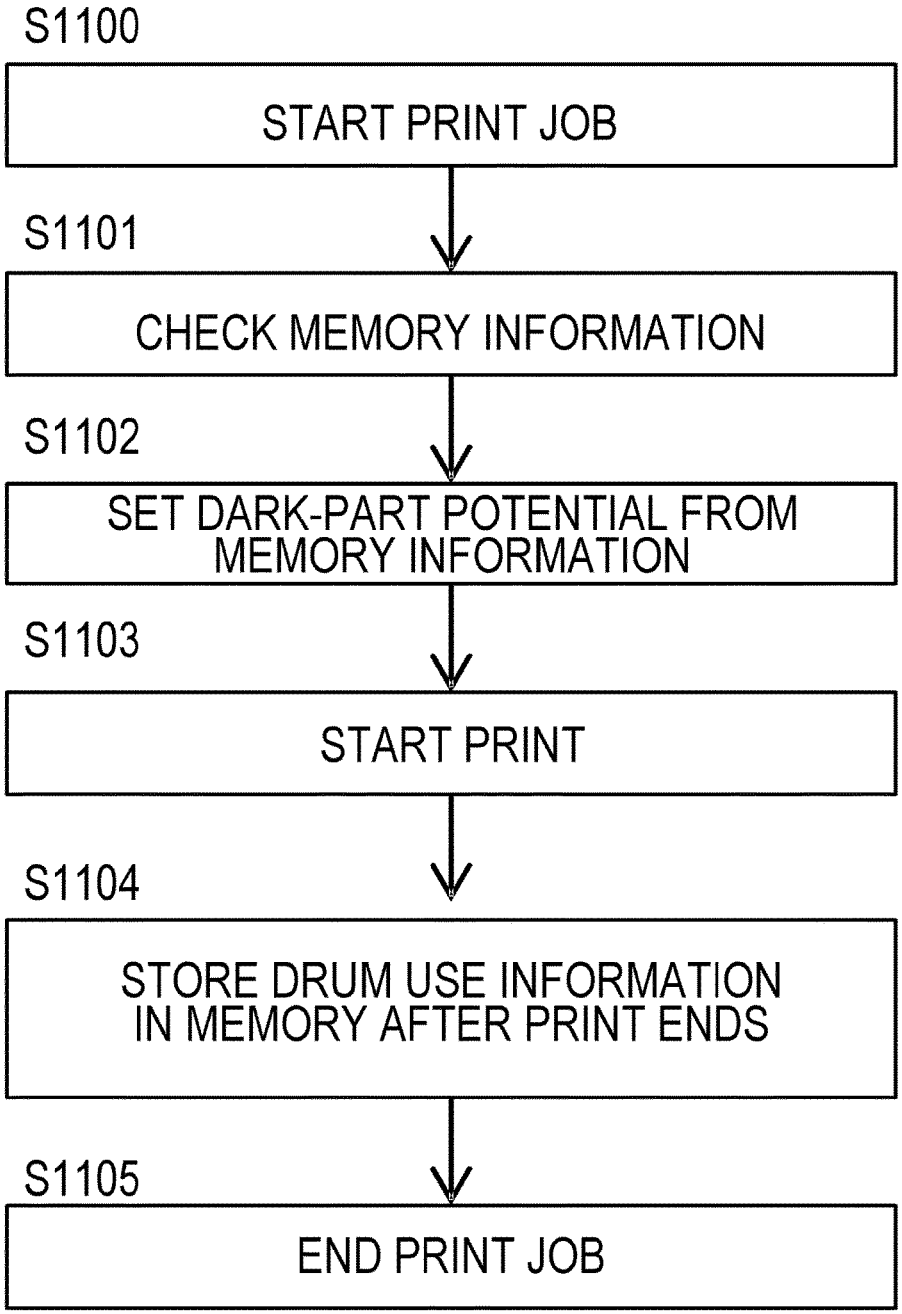
FIG. 8 is a flowchart illustrating the flow of an image forming operation according to Comparative Example 1.

Comparative Example 1 will be described to explain the effects of Embodiment 1. FIG. 8 is a flowchart illustrating the flow of an image forming operation according to Comparative Example 1. In Comparative Example 1, the measurement value is not corrected when the surface potential of the photosensitive drum 1 is measured unlike Embodiment 1.

In S1100, a print job starts similarly to S1000 of Embodiment 1.

In S1101, the control portion S executes a program stored in the memory 50 to acquire the use state of the cartridge similarly to S1001 of Embodiment 1.

In S1102, an exposure amount for forming the dark-part potential portion $V_D$ is derived on the basis of the information stored in the memory 50. Specifically, a relational equation (exposure amount=initial exposure amount+coefficient A×number of rotations of photosensitive drum 1) is stored in the memory 50. However, in Comparative Example 1, since the measurement value of the initial surface potential of the photosensitive drum 1 is not corrected unlike Embodiment 1, the initial exposure amount is not controlled to be a desired value. Therefore, in Comparative Example 1, the dark-part potential $V_D$ is not controlled to be a desired value, and fogging may occur in the recording medium P.

In S1103, a print operation starts similarly to S1008 of Embodiment 1.

In S1104, after the print operation ends, the use state of the photosensitive drum 1 is stored in the memory 50 similarly to S1009 of Embodiment 1.

In S1105, the print job ends similarly to S1010 of Embodiment 1.

(4) Superiority of Embodiment 1 Over Comparative Example 1

In Embodiment 1, the value of the dark-part potential $V_D$ after the cartridge is used for a long period of time will be considered. The error in the measurement value of the surface potential of the photosensitive drum 1 in the present embodiment varies by ±10 V as described above. When the film thickness on the photosensitive drum 1 becomes thin after the cartridge is used for a long period of time, the error in the measurement value of the surface potential of the photosensitive drum 1 may also vary by ±10 V. In this case, the value of the dark-part potential $V_D$ of the photosensitive drum 1 varies by ±20 V in total.

Next, in Comparative Example 1, the value of the dark-part potential $V_D$ after the cartridge is used for a long period of time will be considered. In Comparative Example 1, the error in the measurement value of the surface potential of the photosensitive drum 1 varies within the range of ±60 V unlike the present embodiment. When the film thickness on the photosensitive drum 1 becomes thin after the cartridge is used for a long period of time, the error in the measurement value of the surface potential of the photosensitive drum 1 may also vary by ±10 V. In this case, the value of the dark-part potential $V_D$ of the photosensitive drum 1 varies by ±70 V in total.

Figure 9:
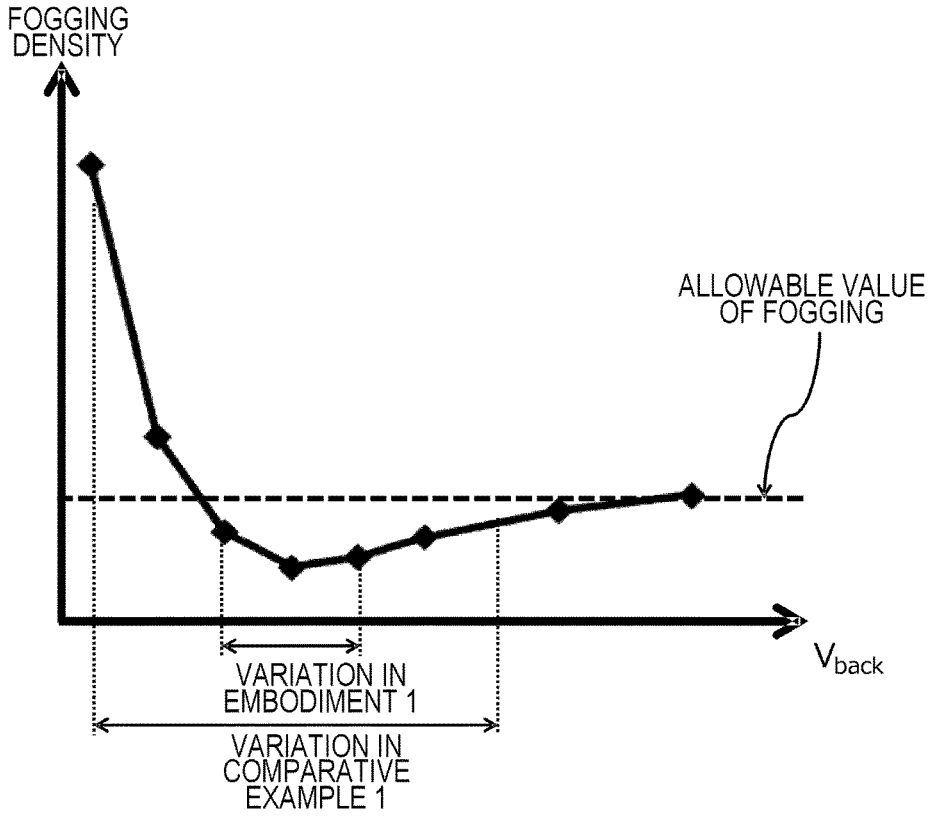
FIG. 9 is a diagram illustrating the relationship between a difference between a dark-part potential and a developing sleeve potential and a fogging density.

Here, FIG. 9 is a diagram illustrating the relationship between the potential difference $V_{back}$ (the difference between the dark-part potential $V_D$ and the potential of the developing sleeve 4) after the cartridge is used for a long period of time and the density of fog occurring on the recording medium P. The relationship between the fogging density and the potential difference $V_{back}$ is as illustrated in FIG. 9. Here, in order to obtain an appropriate image, the fogging density needs to be equal to or smaller than an allowable value. If the fogging density is larger than an allowable value, users can perceive the fogging.

FIG. 9 illustrates an allowable value of the fogging density and a range of variations in the potential difference $V_{back}$ (the difference between the dark-part potential $V_D$ and the potential of the developing sleeve 4) in Embodiment 1 and Comparative Example 1. As illustrated in FIG. 9, in Comparative Example 1, it is likely that the fogging density exceeds the allowable value after the cartridge is used for a long period of time, and an appropriate image is not obtained. In contrast, in Embodiment 1, the fogging density does not exceed the allowable value and an appropriate image can be obtained. As described above, it is understood that Embodiment 1 is superior to Comparative Example 1 in terms of the fogging density.

As described above, in the present embodiment, the charged photosensitive drum 1 is exposed to light with such an exposure amount that an error in the measurement value which is not associated with the transfer roller 5 is very small. Moreover, the difference between the target value and the measurement value of the surface potential after the photosensitive drum 1 is exposed to light is used as an error resulting from the transfer roller 5, and the measurement value of the surface potential of the photosensitive drum 1 is corrected on the basis of the error resulting from the transfer roller 5. Moreover, at least one of the voltage applied to the charging roller 2 and the exposure amount of the scanner 3 is controlled on the basis of the corrected measurement value so that the surface potential of the photosensitive drum 1 reaches the target value. In this way, it is possible to control the dark-part potential $V_D$ of the photosensitive drum 1 to be an appropriate value.

Embodiment 2

Next, Embodiment 2 will be described. In Embodiment 2, the dark-part potential $V_D$ and the bright-part potential $V_L$ of the photosensitive drum 1 can be controlled to be desired values until the cartridge reaches its lifespan from the cartridge starts being used unlike Embodiment 1. Here, the portions of Embodiment 2 having the same functions as those of Embodiment 1 will be denoted by the same reference numerals and the description thereof will not be provided.

(1) Configuration of Present Embodiment

The configuration of the present embodiment will be described in detail.

(a) Reference Surface Potential

In the present embodiment, the value of the surface potential of the photosensitive drum 1 is corrected on the basis of the reference surface potential 1 when the photosensitive drum 1 starts being used (when the cartridge is in a non-used state) unlike Embodiment 1. In addition to this, in the present embodiment, it is possible to stabilize the bright-part potential $V_L$ of the photosensitive drum 1.

Figure 6:
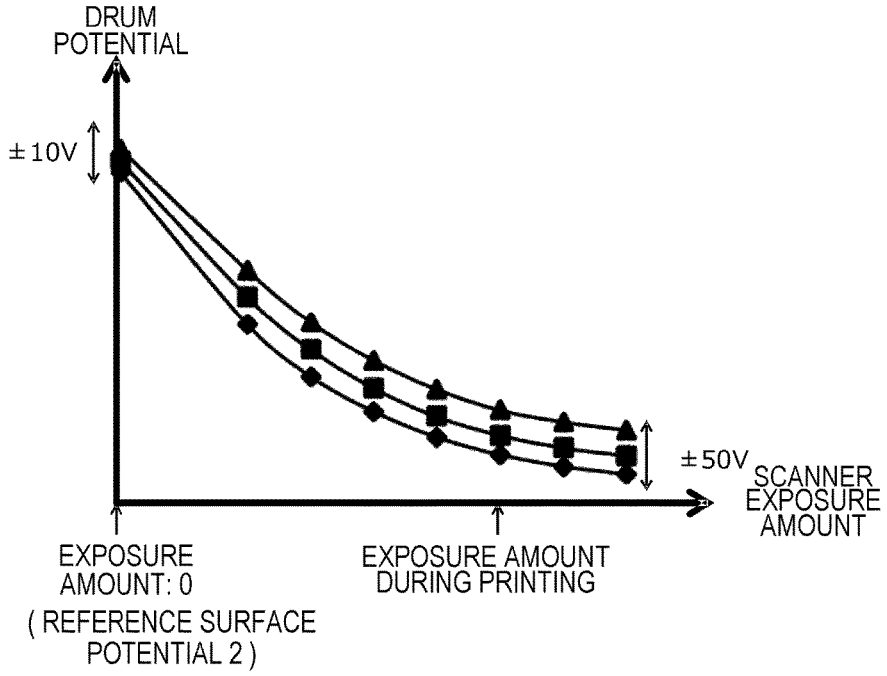
FIG. 6 is a diagram illustrating the relationship between an exposure amount of a scanner and a surface potential of a photosensitive drum.

FIG. 6 is a diagram illustrating the relationship between an exposure amount of the scanner 3 and the bright-part potential $V_L$ of the photosensitive drum 1 in the latter half of the lifespan of the photosensitive drum 1 (after the cartridge is used for a long period of time). As illustrated in FIG. 6, even when the value of the dark-part potential $V_D$ is corrected similarly to Embodiment 1, a variation in the bright-part potential $V_L$ of the photosensitive drum 1 may occur in the latter half of the lifespan of the photosensitive drum 1. The error of ±50 V in the bright-part potential $V_L$ of the photosensitive drum 1 in FIG. 6 occurs due to a variation in the resistance of the photosensitive drum 1, a variation in the sensitivity of the photosensitive layer of the photosensitive drum 1, an unevenness in the thickness of the photosensitive layer, and a use condition (temperature, humidity and the like).

Here, in the present embodiment, as described above, the variation in the bright-part potential $V_L$ of the photosensitive drum 1 is ±50 V in the latter half of the lifespan of the photosensitive drum 1. This is because chipping of the photosensitive layer of the photosensitive drum 1, deterioration in the sensitivity of the photosensitive layer of the photosensitive drum 1, and the like change greatly with the increasing use of the photosensitive drum 1. Due to this, in the present embodiment, a reference surface potential 2 is formed on the surface of the photosensitive drum 1 in the latter half of the lifespan of the photosensitive drum 1. In the present embodiment, the exposure amount (second exposure amount) on the photosensitive drum 1 for forming the reference surface potential 2 is 0. That is, the second exposure amount is smaller than the first exposure amount. Here, the variation in the surface potential of the photosensitive drum 1 when the surface potential of the photosensitive drum 1 is the reference surface potential 2 (second surface potential) is ±10 V. When the variation in the surface potential of the photosensitive drum 1 is ±10 V, exposure may be performed using the second exposure amount rather than 0. In this manner, the absolute value of the reference surface potential 2 is set to be smaller than the absolute value of the reference surface potential 1. As described above, in the present embodiment, the reference surface potential 2 different from the reference surface potential 1 is set in order to measure the error appropriately in the latter half of the lifespan of the photosensitive drum 1 (in the state in which the chipping of the photosensitive layer of the photosensitive drum 1 increases or the sensitivity of the photosensitive layer deteriorates).

(2) Flow of Image Forming Operation of Present Embodiment

Figure 7:
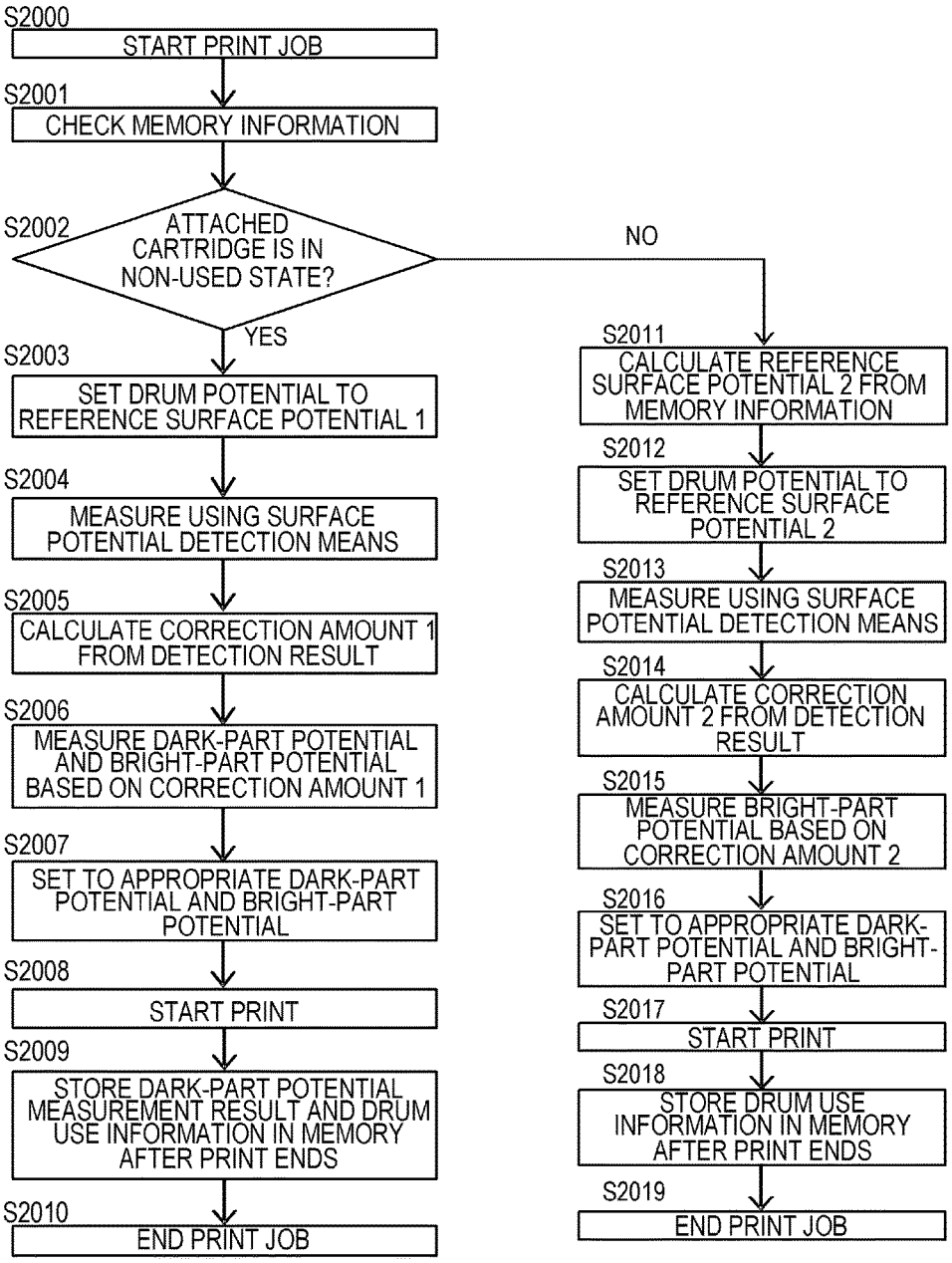
FIG. 7 is a flowchart illustrating the flow of an image forming operation according to the present embodiment.

FIG. 7 is a flowchart illustrating the flow of the image forming operation according to the present embodiment. In the present embodiment, the measurement value of the surface potential of the photosensitive drum 1 is corrected by setting the surface potential of the photosensitive drum 1 to the reference surface potential 2. In this way, the bright-part potential $V_L$ and the dark-part potential $V_D$ of the photosensitive drum 1 can be controlled to be desired values.

In S2000, a print job starts similarly to S1000 of Embodiment 1.

In S2001, the control portion S executes a program stored in the memory 50 to acquire the use state of the cartridge similarly to S1001 of Embodiment 1.

In S2002, the control portion S executes a program stored in the memory 50 to acquire information indicating whether the cartridge is a new product or the cartridge is in a state close to a new product similarly to S1002 of Embodiment 1. When it is determined that the cartridge is in a non-used state, the flow proceeds to S2003. When it is determined that the cartridge is not in the non-used state, the flow proceeds to S2011. That is, when the integrated number of rotations of the photosensitive drum 1 is equal to or smaller than a predetermined threshold, it is determined that the cartridge of which the degree of deterioration is small is a non-used state. When the integrated number of rotations of the photosensitive drum 1 is equal to or larger than the predetermined threshold, it is determined that the cartridge of which the degree of deterioration is small is not a non-used state.

In S2003, a predetermined bias is applied to the charging roller 2 and the photosensitive drum 1 is charged similarly to S1003 of Embodiment 1. Moreover, the scanner 3 exposes the photosensitive drum 1 with a predetermined exposure amount to set the surface potential of the photosensitive drum 1 to the reference surface potential 1 (first surface potential).

In S2004, the surface potential of the photosensitive drum 1 is measured using the transfer roller 5 similarly to S1004 of Embodiment 1.

In S2005, an error in the measurement value of the surface potential of the photosensitive drum 1, measured using the transfer roller 5 is derived similarly to S1005 of Embodiment 1. Specifically, in a state in which the surface potential of the photosensitive drum 1 is controlled to be the reference surface potential 1 (first surface potential), a difference between the measurement value (the measurement value obtained using the transfer roller 5) and the target value (first target value) of the surface potential of the photosensitive drum 1 is referred to an error in the measurement value resulting from the transfer roller 5. This error is stored in the memory 50 as a correction amount 1.

In S2006, the measurement values of the bright-part potential $V_L$ and the dark-part potential $V_D$ of the photosensitive drum 1 are corrected on the basis of the correction amount 1 derived in S2005 similarly to S1006 of Embodiment 1. Specifically, first, the bright-part potential $V_L$ and the dark-part potential $V_D$ of the photosensitive drum 1 are measured using the transfer roller 5. Moreover, by adding or subtracting the correction value calculated in S2005 to or from the measurement value of the surface potential of the photosensitive drum 1 measured using the transfer roller 5, the measurement values of the bright-part potential $V_L$ and the dark-part potential $V_D$ are corrected. In this way, it is possible to measure the surface potential of the photosensitive drum 1 with high accuracy. Moreover, the relationship among the corrected measurement values of the bright-part potential $V_L$ and the dark-part potential $V_D$, the bias applied to the charging roller 2, and the exposure amount of the scanner 3 are derived. The relationship among the measurement values of the bright-part potential $V_L$ and the dark-part potential $V_D$, the bias applied to the charging roller 2, and the exposure amount of the scanner 3 is stored in the memory 50. In the present embodiment, the dark-part potential is determined according to the bias applied to the charging roller 2 only.

In S2007, the bright-part potential $V_L$ and the dark-part potential $V_D$ are controlled to be predetermined potentials on the basis of the information stored in the memory 50 in S2006 (the relationship among the measurement values of the bright-part potential $V_L$ and the dark-part potential $V_D$, the bias applied to the charging roller 2, and the exposure amount of the scanner 3). Specifically, the bias applied to the charging roller 2 and the exposure amount of the scanner 3 are controlled on the basis of the information stored in the memory 50 in S2006 so that the bright-part potential $V_L$ and the dark-part potential $V_D$ reach target values. In this way, the values of the bright-part potential $V_L$ and the dark-part potential $V_D$ have desired values.

Here, in the present embodiment, unlike Embodiment 1, the charging amount on the bright-part potential portion $V_L$ of the photosensitive drum 1 and the exposure amount are also corrected. In the present embodiment, since the measurement accuracy of the initial surface potential of the photosensitive drum 1 is high, the initial charging amount can be controlled to be a desired value and the bright-part potential $V_L$ and the dark-part potential $V_D$ of the photosensitive drum 1 can be controlled to approach desired values. In this way, it is possible to suppress toner from not being transferred to a portion corresponding to the bright-part potential $V_L$ and to suppress toner from being transferred to a portion corresponding to the dark-part potential $V_D$ (that is, fogging can be suppressed).

In S2008, the image forming apparatus A executes a print operation similarly to S1008 of Embodiment 1. Specifically, the control portion S controls the operation of the developing apparatus, the transfer roller 5, the fixing apparatus 6, and the like whereby an image is formed on the recording medium P.

In S2009, after the print operation ends, the information obtained in S2006 (the relationship among the measurement values of the bright-part potential $V_L$ and the dark-part potential $V_D$, the bias applied to the charging roller 2, and the exposure amount of the scanner 3) is stored in the memory 50. Moreover, after the print operation ends, the information (for example, the number of rotations of the photosensitive drum 1) acquired in S2001 and the like are stored in the memory 50.

In S2010, the control portion S controls the operation of devices in the image forming apparatus A whereby the print job ends.

In S2011, the reference surface potential 2 of the photosensitive drum 1 is derived on the basis of the information (the correspondence acquired in S2006, the use state of the photosensitive drum 1, and the like) stored in the memory 50. As described above, in the present embodiment, the correspondence for obtaining the bright-part potential $V_L$ and the dark-part potential $V_D$ (the relationship among the measurement values of the bright-part potential $V_L$ and the dark-part potential $V_D$, the bias applied to the charging roller 2, and the exposure amount of the scanner 3) is stored in the memory 50. Moreover, in addition to this correspondence, the correspondence between the travel distance and the like (the total moving distance of the outer circumferential surface of the photosensitive drum 1) of the photosensitive drum 1, and the reference surface potential 2 is stored in the memory 50. In the present embodiment, the reference surface potential 2 of the photosensitive drum 1 is derived on the basis of these items of information stored in the memory 50, the travel distance and the like of the photosensitive drum 1. In the present embodiment, the correspondence for obtaining the bright-part potential $V_L$ and the dark-part potential $V_D$ is a table, for example.

In S2012, a predetermined bias is applied to the charging roller 2 and the photosensitive drum 1 is charged similarly to S1003 of Embodiment 1. Here, in the present embodiment, the surface potential of the photosensitive drum 1 is controlled to be the reference surface potential 2 (second surface potential) without the scanner 3 exposing the photosensitive drum 1 (exposure amount=0). Specifically, the correspondence among the surface potential of the photosensitive drum 1, the bias applied to the charging roller 2, and the exposure amount of the scanner 3 is stored in the memory 50. The bias applied to the charging roller 2 and the exposure amount of the scanner 3 are determined on the basis of this correspondence.

In S2013, the surface potential of the photosensitive drum 1 is measured using the transfer roller 5 similarly to S1004 of Embodiment 1.

In S2014, an error in the measurement value of the surface potential of the photosensitive drum 1, measured using the transfer roller 5 is derived similarly to S1005 of Embodiment 1. Specifically, in a state in which the surface potential of the photosensitive drum 1 is controlled to be the reference surface potential 2 (second surface potential), a difference between the measurement value (the measurement value obtained using the transfer roller 5) and the target value (second target value) of the surface potential of the photosensitive drum 1 is referred to an error in the measurement value resulting from the transfer roller 5. This error is stored in the memory 50 as a correction amount 2.

In S2015, the bright-part potential $V_L$ of the photosensitive drum 1 is measured using the transfer roller 5. The bright-part potential $V_L$ measured using the transfer roller 5 is corrected using the correction amount 2. In this way, the measurement value of the bright-part potential $V_L$ of the photosensitive drum 1 is corrected to an appropriate value.

In S2016, the bright-part potential $V_L$ of the photosensitive drum 1 is controlled to be a desired value on the basis of the measurement result obtained in S2015 and the information (the correspondence acquired in S2006, the use state of the photosensitive drum 1, and the like) stored in the memory 50. Specifically, similarly to S1007 of Embodiment 1, the charging amount on the photosensitive drum 1 of the charging roller 2 and the exposure amount on the photosensitive drum 1 of the scanner 3 are derived on the basis of the corrected measurement value of the bright-part potential $V_L$ of the photosensitive drum 1. The photosensitive drum 1 is charged and exposed to light by the derived exposure amount and charging amount. In this way, the bright-part potential $V_L$ of the photosensitive drum 1 is controlled to be a desired value.

On the other hand, the dark-part potential $V_D$ of the photosensitive drum 1 is controlled to be a desired value by the same method as S1007 of Embodiment 1. Specifically, the charging amount on the photosensitive drum 1 of the charging roller 2 is derived on the basis of the measurement value of the surface potential of the photosensitive drum 1 corrected using the correction amount 1, and the photosensitive drum 1 is charged using the charging amount.

In S2017, the image forming apparatus A executes the print operation similarly to S1008 of Embodiment 1.

In S2018, after the print operation ends, the initial exposure amount obtained in S2007, the information acquired in S2001 (for example, the number of rotations of the photosensitive drum 1), and the like are stored in the memory 50 similarly to S1009 of Embodiment 1.

In S2019, the control portion S controls the operation of devices in the image forming apparatus A whereby the print job ends.

In the present embodiment, although the use state (the total number of rotations and the like of the photosensitive drum 1) of the photosensitive drum 1 is stored in the memory 50 in S2009 and S2018, the present invention is not necessarily limited thereto. However, it is sufficient that the difference between the dark-part potential $V_D$ of the photosensitive drum 1 and the potential of the developing sleeve 4 can be controlled to be a desired value. For example, the correction amount obtained in S2005 may be stored in the memory 50, and the dark-part potential portion $V_D$ of the photosensitive drum 1 may be formed using this correction amount 1 in S1011.

In the present embodiment, although the dark-part potential $V_D$ is controlled to be a desired value so that an appropriate image is formed until the cartridge reaches its lifespan, the present invention is not necessarily limited thereto. However, it is sufficient that the difference (hereinafter referred to as a potential difference $V_{back}$) between the dark-part potential $V_D$ and the potential of the developing sleeve 4 and the difference (hereinafter referred to as a potential difference $V_{cont}$) between the bright-part potential $V_L$ and the potential of the developing sleeve 4 can be controlled to be desired values. For example, the potential differences $V_{cont}$ and $V_{back}$ may be controlled to be desired values by correcting the potential of the developing sleeve 4.

(4) Comparative Example 2

Figure 10:
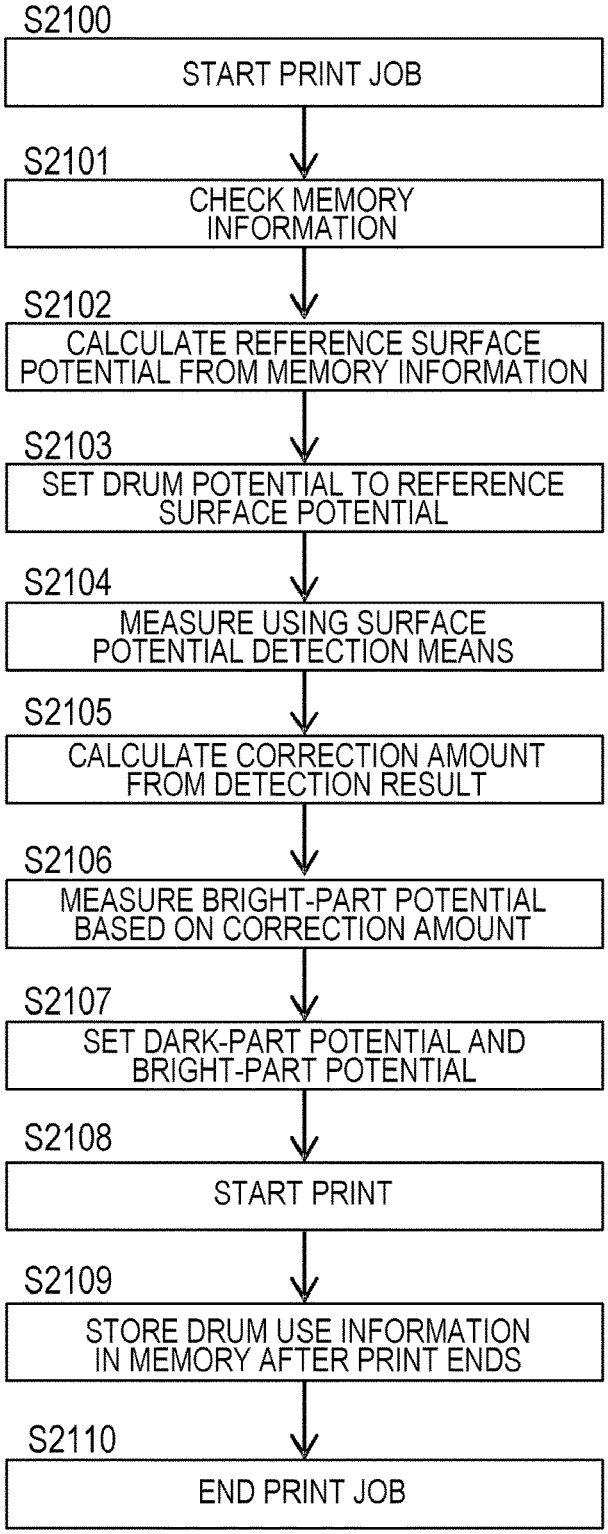
FIG. 10 is a flowchart illustrating the flow of an image forming operation according to Comparative Example 2.

Comparative Example 2 will be described to explain the effects of Embodiment 2. In Comparative Example 2, the surface potential of the photosensitive drum 1 is not controlled to be the reference surface potential 1 and the dark-part potential $V_D$ is not corrected when the cartridge starts being used unlike Embodiment 2. The dark-part potential $V_D$ at a predetermined timing is referred to as a reference potential and the surface potential of the photosensitive drum 1 is corrected. Here, FIG. 10 is a flowchart illustrating the flow of an image forming operation according to Comparative Example 2.

In S2100, a print job starts similarly to S1000 of Embodiment 1.

In S2101, the control portion S executes a program stored in the memory 50 to acquire the use state of the cartridge similarly to S1001 of Embodiment 1.

In S2102, the reference potential of the photosensitive drum 1 is derived on the basis of the information stored in the memory 50. Here, in Comparative Example 2, the reference potential is not such a potential that an error other than the error resulting from the transfer roller 5 is very small unlike Embodiment 2.

In S2103, the control portion S controls the bias applied to the charging roller 2 whereby the charging roller 2 charges the photosensitive drum 1 and the surface potential of the photosensitive drum 1 is controlled to be the reference potential calculated in S2102. Specifically, the correspondence between the bias applied to the charging roller 2 and the surface potential of the photosensitive drum 1 is stored in advance in the memory 50. The bias applied to the charging roller 2 is determined on the basis of the correspondence stored in the memory 50 and the reference potential calculated in S2102.

In S2104, the surface potential of the photosensitive drum 1 is measured using the transfer roller 5 similarly to S1004 of Embodiment 1.

In S2105, the control portion S executes a program stored in the memory 50 whereby an error in the measurement value of the surface potential of the photosensitive drum 1, measured using the transfer roller 5 is derived. Specifically, in Comparative Example 2, unlike Embodiment 2, the reference potential is not such a potential that an error other than the error resulting from the transfer roller 5 is very small. Due to this, a variation in the error resulting from the transfer roller 5 increases, and the corrected measurement value of the surface potential of the photosensitive drum 1 also varies.

In S2106, the photosensitive drum 1 is charged and exposed to light, and the bright-part potential $V_L$ of the photosensitive drum 1 is measured using the transfer roller 5. The measurement value of the bright-part potential $V_L$ of the photosensitive drum 1 is corrected using the correction amount derived in S2105. However, in Comparative Example 2, since the correction amount derived in S2105 has an error, the measurement value of the bright-part potential $V_L$ does not have an appropriate value.

In S2107, the dark-part potential $V_D$ and the bright-part potential $V_L$ of the photosensitive drum 1 are controlled to be predetermined values on the basis of the measurement value and the correction amount of the bright-part potential $V_L$ in S2106 and the use state of the cartridge stored in the memory 50. Here, in Comparative Example 2, since the measurement value of the bright-part potential $V_L$ and the correction amount calculated in S2105 have errors, the actual dark-part potential $V_D$ and the actual bright-part potential $V_L$ do not have correct values. Due to this, in Comparative Example 2, image defects such as fogging may occur.

In S2108, the image forming apparatus A executes a print operation similarly to S1008 of Embodiment 1.

In S2109, the information (for example, the number of rotations of the photosensitive drum 1) acquired in S2101 and the like are stored in the memory 50.

In S2110, the control portion S controls the operation of devices in the image forming apparatus A whereby the print job ends.

(4) Superiority of Embodiment 2 Over Comparative Example 2

In Embodiment 2, the value of the dark-part potential $V_D$ after the cartridge is used for a long period of time will be considered. The error in the measurement value of the surface potential of the photosensitive drum 1 in the present embodiment varies by ±10 V as described above. When the film thickness on the photosensitive drum 1 becomes thin after the cartridge is used for a long period of time, the error in the measurement value of the surface potential of the photosensitive drum 1 may also vary by ±10 V. In this case, the value of the dark-part potential $V_D$ of the photosensitive drum 1 varies by ±20 V in total. On the other hand, the value of the bright-part potential $V_L$ of the photosensitive drum 1 varies by ±20 V in total.

Next, in Comparative Example 2, the value of the dark-part potential $V_D$ after the cartridge is used for a long period of time will be considered. In Comparative Example 2, the error in the measurement value of the surface potential of the photosensitive drum 1 varies within the range of ±60 V unlike the present embodiment. When the film thickness on the photosensitive drum 1 becomes thin after the cartridge is used for a long period of time, the error in the measurement value of the surface potential of the photosensitive drum 1 may also vary by ±10 V. In this case, the value of the dark-part potential $V_D$ of the photosensitive drum 1 varies by ±70 V in total. On the other hand, the value of the bright-part potential $V_L$ of the photosensitive drum 1 varies by ±70 V in total.

Figure 11:
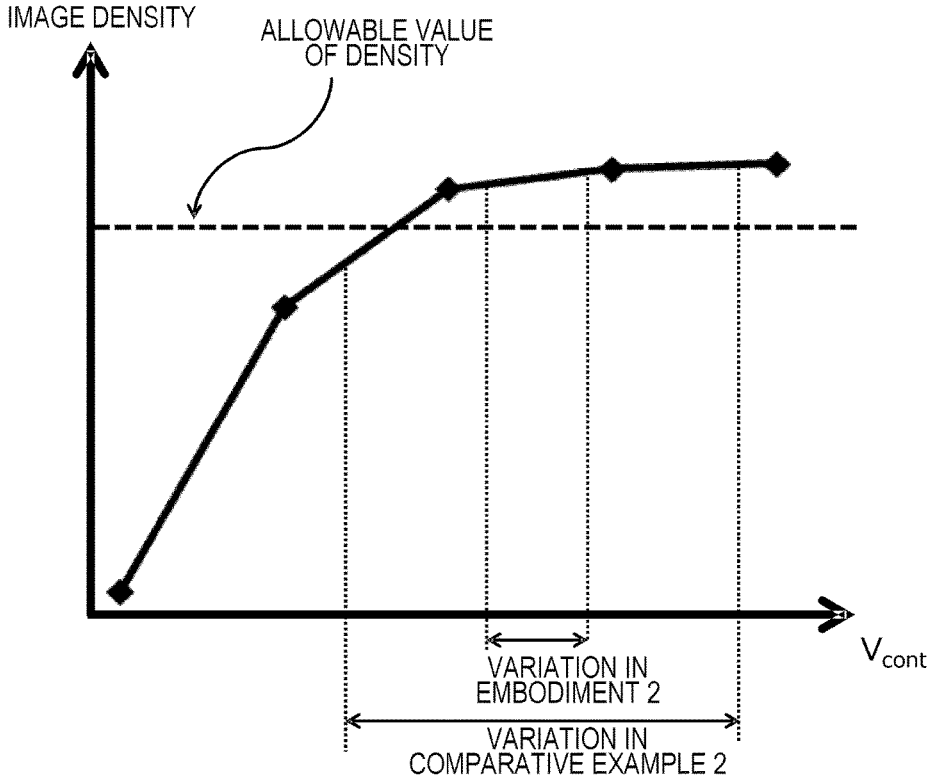
FIG. 11 is a diagram illustrating the relationship between a difference between a bright-part potential and a developing sleeve potential and an image density.

Here, FIG. 11 is a diagram illustrating the relationship between the potential difference $V_{cont}$ (the difference between the bright-part potential $V_L$ and the potential of the developing sleeve 4) after the cartridge is used for a long period of time and the density of an image formed on the recording medium P. The relationship between the image density and the potential difference $V_{cont}$ is as illustrated in FIG. 11. Here, in order to obtain an appropriate image, the density of an image formed on the recording medium P needs to be equal to or larger than an allowable value. If the image density is smaller than an allowable value, the corresponding portion is omitted from the image.

FIG. 11 illustrates an allowable value of the image density and a range of variations in the potential difference $V_{cont}$ (the difference between the bright-part potential $V_L$ and the potential of the developing sleeve 4) in Embodiment 2 and Comparative Example 2. As illustrated in FIG. 11, in Comparative Example 2, it is likely that the image density does not reach the allowable value after the cartridge is used for a long period of time, and an appropriate image is not obtained. In contrast, in Embodiment 2, the image density does not fall below the allowable value and an appropriate image can be obtained. As described above, it is understood that Embodiment 2 is superior to Comparative Example 2 in terms of the image density.

As described above, in the present embodiment, when the degree of deterioration of the cartridge is equal to or smaller than a threshold, the difference between the target value and the measurement value of the surface potential of the photosensitive drum 1 after the photosensitive drum 1 is exposed to light by a first exposure amount is referred to as a first error resulting from the transfer roller 5. The measurement value is corrected on the basis of the first error. At least one of the voltage applied to the charging roller 2 and the exposure amount of the scanner 3 is controlled on the basis of the corrected measurement value so that the potentials of an image forming portion and a non-image forming portion on the photosensitive drum 1 reach target values. On the other hand, when the degree of deterioration of the cartridge is larger than a threshold, the difference between the target value and the measurement value of the surface potential of the photosensitive drum 1 after the photosensitive drum 1 is exposed to light by a second exposure amount smaller than the first exposure amount is referred to as a second error resulting from the transfer roller 5. The measurement value is corrected on the basis of the second error. At least one of the voltage applied to the charging roller 2 and the exposure amount of the scanner 3 is controlled on the basis of the measurement value corrected using the first error stored in the memory 50 so that the potential of the non-image forming portion reaches the target value. Moreover, at least one of the voltage applied to the charging roller 2 and the exposure amount of the scanner 3 is controlled on the basis of the measurement value corrected using the second error so that the potential of the image forming portion reaches the target value. In this way, the dark-part potential $V_D$ and the bright-part potential $V_L$ on the photosensitive drum 1 can be controlled to be appropriate values.

In the respective embodiments, although the measurement value of the surface potential of the photosensitive drum 1 is corrected by subtracting an error resulting from the transfer roller 5 from the measurement value of the surface potential of the photosensitive drum 1, the present invention is not necessarily limited thereto. For example, the measurement value of the surface potential of the photosensitive drum 1 may be corrected according to a table using the measurement value of the surface potential of the photosensitive drum 1 and the error resulting from the transfer roller 5.

In the respective embodiments, although it is determined that the cartridge is in a state close to a new product when the value for calculating the degree of deterioration of the cartridge is equal to or larger than the threshold, the present invention is not necessarily limited thereto. For example, it may be determined that the cartridge is in a state close to a new product when the value for calculating the degree of deterioration of the cartridge is larger than a threshold. Expressions "equal to or larger than" and "larger than" and expressions "equal to or smaller than" and "smaller than" used to express the magnitudes in relationship to the threshold may be used appropriately selectively.

In the respective embodiments, the degree of deterioration of the cartridge may not be calculated on the basis of the integrated number of rotations or the like of the photosensitive drum 1. A method of acquiring the degree of deterioration of the cartridge is not particularly limited as long as the degree of deterioration of the cartridge can be acquired.

In the respective embodiments, the relationship among the target value of the surface potential of the photosensitive drum 1, at least one of the voltage applied to the charging roller 2 and the exposure amount of the scanner 3, and the measurement value of the surface potential of the photosensitive drum 1 may be a calculation equation and may be a table. These relationships are not particularly limited as long as at least one of the voltage applied to the charging roller 2 and the exposure amount of the scanner 3 can be acquired.

In the respective embodiments, the reference surface potential may not be such a surface potential of the photosensitive drum 1 that an error other than the error in the measurement result obtained using the transfer roller 5 is minimized. For example, the reference surface potential may be such a surface potential of the photosensitive drum 1 that an error other than the error in the measurement result obtained by the transfer roller 5 decreases.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-133375, filed Jul. 5, 2016, which is hereby incorporated by reference herein in its entirety.

What is claimed is:

1. An image forming apparatus comprising:

an image bearing member on which a developer image is formed;

a charging member that charges a surface of the image bearing member;

an exposure apparatus that exposes the charged image bearing member to light in order to form an electrostatic latent image on the image bearing member;

a measurement member for measuring a surface potential of the image bearing member;

a first voltage application unit for applying a voltage to the charging member;

a second voltage application unit for applying a voltage to the measurement member; and a control portion that controls the voltage applied to the charging member by the first voltage application unit, the voltage applied to the measurement member by the second voltage application unit, and an exposure amount of the exposure apparatus, wherein the control portion executes a measurement step of calculating as a measurement value the surface potential of the image bearing member on the basis of a voltage value of the voltage applied by the second voltage application unit and a current value of a current flowing into the measurement member from the image bearing member in a state that the voltage is applied by the second voltage application unit, and wherein the control portion executes:

(i) a step of calculating, in the measurement step, the surface potential of the image bearing member when the image bearing member charged by the charging member, to which a predetermined voltage is applied, is exposed to light by a predetermined exposure amount and calculating a correction value from a difference between a target value and the surface potential of the image bearing member calculated in the measurement step;

(ii) a step of correcting the surface potential of the image bearing member calculated in the measurement step on the basis of the correction value; and (iii) a step of controlling at least one of the voltage applied to the charging member or the exposure amount of the exposure apparatus on the basis of the corrected surface potential of the image bearing member so that the surface potential of the image bearing member reaches the target value.

2. The image forming apparatus according to claim 1, wherein the predetermined exposure amount is an exposure amount at which an error in the measurement value, which is not associated with the measurement member, is smaller than an error in the measurement value, which is not associated with the measurement member, when an image is formed on a recording medium.

3. The image forming apparatus according to claim 1, wherein the predetermined exposure amount is larger than an exposure amount with which the exposure apparatus exposes the image bearing member to light when an image is formed on a recording medium.

4. The image forming apparatus according to claim 1, further comprising a storage portion that stores a relationship among the target value of the surface potential of the image bearing member, the voltage applied to the charging member, and the corrected surface potential of the image bearing member, wherein the control portion controls the voltage applied to the charging member on the basis of the relationship and the corrected surface potential of the image bearing member.

5. The image forming apparatus according to claim 1, wherein the measurement member is a transfer member for transferring the developer image formed on the image bearing member to a recording medium.

6. The image forming apparatus according to claim 1, wherein the measurement member is a transfer roller for transferring the developer image formed on the image bearing member to a recording medium.

7. The image forming apparatus according to claim 1, wherein the image bearing member charged by the charging member is exposed to light thereby forming the electrostatic latent image on the image bearing member, wherein the electrostatic latent image formed on the image bearing member is developed as the developer image, and wherein the developer image on the image bearing member is transferred to a recording medium thereby forming an image on the recording medium.

8. An image forming apparatus comprising:

a cartridge that includes an image bearing member on which a developer image is formed;

a charging member that charges a surface of the image bearing member;

an exposure apparatus that exposes the charged image bearing member to light in order to form an electrostatic latent image on the image bearing member;

a measurement member for measuring a surface potential of the image bearing member;

a first voltage application unit for applying a voltage to the charging member;

a second voltage application unit for applying a voltage to the measurement member; and a control portion that controls the voltage applied to the charging member by the first voltage application unit, the voltage applied to the measurement member by the second voltage application unit, and an exposure amount of the exposure apparatus, wherein the control portion executes a measurement step of calculating the surface potential of the image bearing member on the basis of a voltage value of the voltage applied by the second voltage application unit and a current value of a current flowing into the measurement member from the image bearing member in a state that the voltage is applied by the second voltage application unit, wherein the control portion acquires a degree of deterioration of the cartridge on the basis of a use state of the cartridge, wherein, when the degree of deterioration of the cartridge is equal to or smaller than a threshold, the control portion executes:

(i) a step of calculating, in the measurement step, a first surface potential of the image bearing member when the image bearing member charged by the charging member, to which a predetermined voltage is applied, is exposed to light by a first exposure amount and calculating a first correction value from a difference between a first target value and the first surface potential of the image bearing member calculated in the measurement step;

(ii) a step of correcting the surface potential of the image bearing member calculated in the measurement step on the basis of the first correction value; and (iii) a step of controlling at least one of the voltage applied to the charging member or the exposure amount of the exposure apparatus on the basis of the corrected surface potential of the image bearing member so that the surface potential of the image bearing member reaches the first target value, wherein, when the degree of deterioration of the cartridge is equal to or larger than the threshold, the control portion executes:

(iv) a step of calculating, in the measurement step, a second surface potential of the image bearing member when the image bearing member charged by the charging member, to which the predetermined voltage is applied, is not exposed to light and calculating a second correction value from a difference between a second target value and the second surface potential of the image bearing member calculated in the measurement step;

(v) a step of correcting the surface potential of the image bearing member calculated in the measurement step on the basis of the second correction value; and (vi) a step of controlling at least one of the voltage applied to the charging member or the exposure amount of the exposure apparatus on the basis of the corrected surface potential of the image bearing member so that the surface potential of the image bearing member reaches the second target value.

9. The image forming apparatus according to claim 8, wherein the first exposure amount is larger than an exposure amount with which the exposure apparatus exposes the image bearing member to light when an image is formed on a recording medium.

10. The image forming apparatus according to claim 8, wherein the image bearing member is a photosensitive drum, the image forming apparatus further comprises a storage portion that stores a relationship between the degree of deterioration of the cartridge and at least one of the number of rotations of the photosensitive drum, a rotation period of the photosensitive drum, a period in which the photosensitive drum is charged by the charging member, or a developer consumption amount, and wherein the control portion acquires the degree of deterioration of the cartridge on the basis of the relationship and at least one of the number of rotations of the photosensitive drum, the rotation period of the photosensitive drum, the period in which the photosensitive drum is charged by the charging member, or the developer consumption amount.

11. The image forming apparatus according to claim 8, further comprising a storage portion that stores a relationship among the target value of the surface potential of the image bearing member, the voltage applied to the charging member, and the corrected surface potential of the image bearing member, wherein the control portion controls the voltage applied to the charging member to be a predetermined voltage on the basis of the relationship and the corrected surface potential of the image bearing member so that the surface potential of the image bearing member reaches the target value.

12. The image forming apparatus according to claim 8, wherein the measurement member is a transfer member for transferring the developer image formed on the image bearing member to a recording medium.

13. The image forming apparatus according to claim 8, wherein the measurement member is a transfer roller for transferring the developer image formed on the image bearing member to a recording medium.

14. The image forming apparatus according to claim 8, wherein the image bearing member charged by the charging member is exposed to light thereby forming the electrostatic latent image on the image bearing member, wherein the electrostatic latent image formed on the image bearing member is developed as the developer image, and wherein the developer image on the image bearing member is transferred to a recording medium thereby forming an image on the recording medium.

15. The image forming apparatus according to claim 8, wherein the control portion calculates, in the measurement step, the surface potential of the image bearing member as a measurement value on the basis a discharge start voltage between the measurement member and the image bearing member.

16. An image forming apparatus comprising:

an image bearing member on which a developer image is formed;

a charging member that charges a surface of the image bearing member;

an exposure apparatus that exposes the charged image bearing member to light in order form an electrostatic latent image on the image bearing member;

a measurement member for measuring a surface potential of the image bearing member;

a first voltage application unit for applying a voltage to the charging member;

a second voltage application unit for applying a voltage to the measurement member; and a control portion that controls the voltage applied to the charging member by the first voltage application unit, the voltage applied to the measurement member by the second voltage application unit, and an exposure amount of the exposure apparatus, wherein the control portion executes a measurement step of calculating the surface potential of the image bearing member, wherein the control portion acquires a degree of deterioration of the image bearing member on the basis of a use state of the image bearing member, wherein, when an integrated number of rotations of the image bearing member is equal to or less than a threshold, the control portion executes:

(i) a step of calculating, in the measurement step, a first surface potential of the image bearing member when the image bearing member charged by the charging member, to which a predetermined voltage is applied, is exposed to light by a first exposure amount and calculating a first correction value from a difference between a first target value and a first surface potential of the image bearing member calculated in the measurement step;

(ii) a step of correcting the surface potential of the image bearing member calculated in the measurement step on the basis of the first correction value; and (iii) a step of controlling at least one of the voltage applied to the charging member or the exposure amount of the exposure apparatus on the basis of the corrected surface potential of the image bearing member so that the surface potential of the image bearing member reaches the first target value, wherein, when the integrated number of rotations of the image bearing member is equal to or greater than the threshold, the control portion executes:

(iv) a step of calculating, in the measurement step, a second surface potential of the image bearing member when the image bearing member charged by the charging member, to which the predetermined voltage is applied, is exposed to light by a second exposure amount smaller than the first exposure amount and calculating a second correction value from a difference between a second target value and the second surface potential of the image bearing member calculated in the measurement step;

(v) a step of correcting the surface potential of the image bearing member calculated in the measurement step on the basis of the second correction value; and (vi) a step of controlling at least one of the voltage applied to the charging member or the exposure amount of the exposure apparatus on the basis of the corrected surface potential of the image bearing member so that the surface potential of the image bearing member reaches the second target value.

17. The image forming apparatus according to claim 16, wherein the first exposure amount is larger than an exposure amount with which the image bearing member is exposed to light by the exposure apparatus when an image is formed on a recording medium.

18. The image forming apparatus according to claim 16, wherein the measurement member is a transfer roller for transferring the developer image formed on the image bearing member to a recording medium.

19. The image forming apparatus according to claim 16, wherein the control portion calculates, in the measurement step, the surface potential of the image bearing member as a measurement value on the basis of a voltage value of the voltage applied by the second voltage application unit and a current value of a current flowing into the measurement member from the image bearing member in a state that the voltage is applied by the second voltage application unit.

* * * * *